US007358433B2

(12) United States Patent
Kondo et al.

(10) Patent No.: US 7,358,433 B2
(45) Date of Patent: Apr. 15, 2008

(54) AUTOMATIC ACCOMPANIMENT APPARATUS AND A STORAGE DEVICE STORING A PROGRAM FOR OPERATING THE SAME

(75) Inventors: Masao Kondo, Hamamatsu (JP); Satoshi Miyata, Hamamatsu (JP)

(73) Assignee: Yamaha Corporation (JP)

( * ) Notice: Subject to any disclaimer, the term of this patent is extended or adjusted under 35 U.S.C. 154(b) by 179 days.

(21) Appl. No.: 10/931,575

(22) Filed: Sep. 1, 2004

(65) Prior Publication Data

US 2005/0145098 A1 Jul. 7, 2005

Related U.S. Application Data

(63) Continuation of application No. 10/091,814, filed on Mar. 4, 2002, now Pat. No. 6,852,918.

(30) Foreign Application Priority Data

Mar. 5, 2001 (JP) ..... 2001-060771

(51) Int. Cl.
*G10H 1/36* (2006.01)
*G10H 7/00* (2006.01)

(52) U.S. Cl. ..... 84/610

(58) Field of Classification Search ..... 84/609–613, 84/634–637

See application file for complete search history.

(56) References Cited

U.S. PATENT DOCUMENTS 4,893,538 A 1/1990 Masaki et al.
5,457,282 A 10/1995 Miyamoto et al. ..... 84/634
5,481,066 A 1/1996 Kitamura ..... 84/637
5,668,337 A 9/1997 Kondo et al. ..... 84/609
5,698,804 A 12/1997 Mizuno
5,736,664 A 4/1998 Ito et al. ..... 84/634
5,750,914 A 5/1998 Takahashi
5,831,195 A 11/1998 Nakata ..... 84/609
5,920,025 A 7/1999 Itoh et al. ..... 84/611
6,194,648 B1 2/2001 Takahashi et al.
6,215,059 B1 4/2001 Rauchi et al. ..... 84/611
6,376,760 B1 4/2002 Tozuka et al. ..... 84/635

FOREIGN PATENT DOCUMENTS

JP 62-200399 A 9/1987

(Continued)

OTHER PUBLICATIONS

Decision of Refusal, dated Nov. 8, 2005, issued in the corresponding Japanese Application 2001-060771.

(Continued)

*Primary Examiner*—Jeffrey W Donels
(74) *Attorney, Agent, or Firm*—Rossi, Kimms & McDowell LLP

(57) ABSTRACT

An automatic accompaniment apparatus includes: a storage unit for storing accompaniment style data including basic accompaniment data for automatic accompaniment and replacement accompaniment data to be reproduced in place of the basic accompaniment data; and a reproducing unit for reading the stored accompaniment style data and reproducing the read accompaniment style data, the reproducing unit reproducing the read accompaniment style data by replacing a portion thereof with the replacement accompaniment data. The automatic accompaniment apparatus can generate derivative accompaniment style data from original accompaniment data with ease.

9 Claims, 14 Drawing Sheets

FOREIGN PATENT DOCUMENTS

| | | | |
|---|---|---|---|
| JP | 04-057094 | | 2/1992 |
| JP | 4057094 | | 2/1992 |
| JP | 4-331994 | A | 11/1992 |
| JP | 5-173568 | A | 7/1993 |
| JP | 06-165707 | A | 6/1994 |
| JP | 6-202658 | A | 7/1994 |
| JP | 6-230877 | A | 8/1994 |
| JP | 06-318072 | A | 11/1994 |
| JP | 7-49692 | A | 2/1995 |
| JP | 07-181973 | A | 7/1995 |
| JP | 8-87270 | A | 4/1996 |
| JP | 8-95563 | A | 4/1996 |
| JP | 08-221063 | | 8/1996 |
| JP | 8221063 | A1 | 8/1996 |
| JP | 08-27369 | | 10/1996 |
| JP | 8-254982 | A | 10/1996 |
| JP | 8-272369 | A | 10/1996 |
| JP | 9-26786 | A | 1/1997 |
| JP | 09-026786 | A | 1/1997 |
| JP | 10-207460 | | 8/1998 |
| JP | 10-254439 | A | 9/1998 |
| JP | 11-085158 | A | 3/1999 |
| JP | 11-126068 | A | 5/1999 |
| JP | 11-212564 | | 8/1999 |
| JP | 2000-172262 | A | 6/2000 |
| JP | 2000-221969 | A | 8/2000 |
| JP | 2001-13964 | A | 1/2001 |

OTHER PUBLICATIONS

Notice of Reasons of Rejection, dated Apr. 5, 2005, issued in the corresponding Japaneses Application 2001-060771.

Notice of Reasons of Rejection, dated Aug. 2, 2005, issued in the corresponding Japaneses Application 2001-060771.

Relevant Portion of Japanese Office Action issued in counterpart Japanese Patent Application No. 2005-165707, with mailing date Apr. 3, 2007.

Relevant Portion of Japanese Office Action issued in counterpart Japanese Patent Application No. 2005-165705, with mailing date Mar. 13, 2007. (Cited in IDS filed on Jun. 15, 2007; translation is provided herewith).

Relevant Portions of Japanese Office Action issued in counterpart Japanese Patent Application No. 2005-165706, with mailing date of Mar. 13, 2007. (Cited in IDS filed on Jun. 15, 2007; translation is provided herwith).

Relevant Portion of Japanese Office Action issued in counterpart Japanese Patent Application No. 2005-165705, with mailing date Mar. 13, 2007.

Relevant Portions of Japanese Office Action issued in counterpart Japanese Patent Application No. 2005-165706, with mailing date of Mar. 13, 2007.

Office Action issued in the corresponding Japanese application No.: 2005-165705 mailed Jul. 31, 2007.

Office Action issued in the corresponding Japanese application No.: 2005-165706 mailed Jul. 31, 2007.

Office Action issued in the corresponding Japanese application No.: 2005-352840 mailed Aug. 7, 2007.

Office Action issued in corresponding Japanese application No: 2005-352840, mailed on Aug. 7, 2007.

Information Statement filed in corresponding to Japanese Patent Application No.: 2005-165706, filed on Feb. 28, 2007.

Information Statement filed in corresponding to Japanese Patent Application No.: 2005-352840, filed on Jun. 27, 2007.

FIG.8

| PROGRAM NO. | BANK 1 | BANK 2 | ··· |
|---|---|---|---|
| 1 | GUITAR CUTTING 1 | GUITAR CUTTING 2 | ··· |
| 2 | GUITAR RIFF 1 | GUITAR RIFF 2 | ··· |
| 3 | GUITAR STRUM | ← | ··· |
| 4 | DRUM FILL 1 | DRUM FILL 2 | ··· |
| ⋮ | ⋮ | ⋮ | ··· |

FIG.9

| PROGRAM NO. | BANK 1 | BANK 2 | ··· |
|---|---|---|---|
| 1 | STANDARD DUET 1 | STANDARD DUET 2 | ··· |
| 2 | ROCK DUET 1 | ← | ··· |
| 3 | COUNTRY DUET 1 | COUNTRY DUET 2 | ··· |
| 4 | STANDARD TRIO 1 | STANDARD TRIO 2 | ··· |
| ⋮ | ⋮ | ⋮ | ··· |

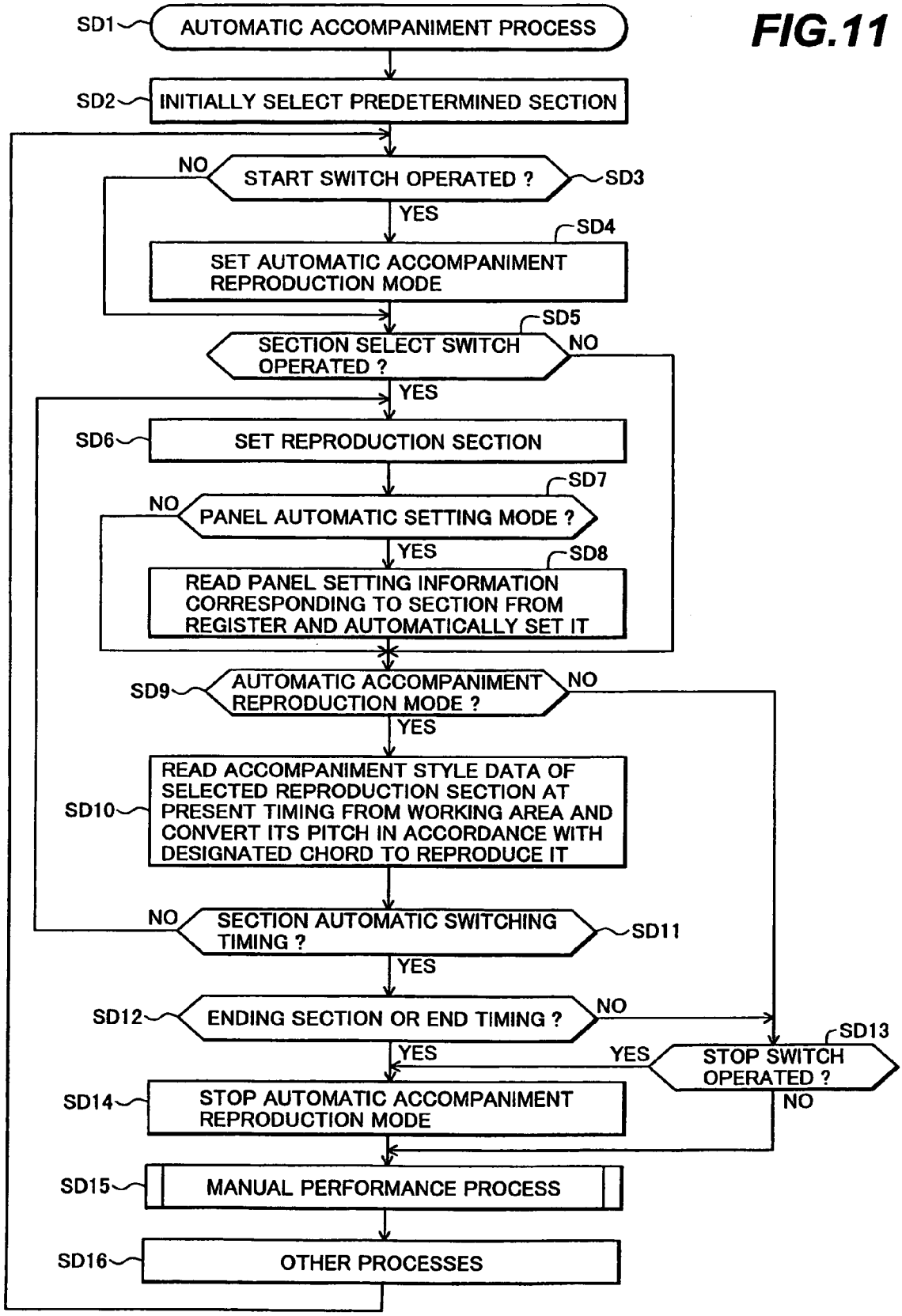
FIG.11
SD1
AUTOMATIC ACCOMPANIMENT PROCESS
SD2
INITIALLY SELECT PREDETERMINED SECTION
NO
START SWITCH OPERATED ?
SD3
YES
SD4
SET AUTOMATIC ACCOMPANIMENT REPRODUCTION MODE
SD5
SECTION SELECT SWITCH OPERATED ?
NO
YES
SD6
SET REPRODUCTION SECTION
SD7
NO
PANEL AUTOMATIC SETTING MODE ?
YES
SD8
READ PANEL SETTING INFORMATION CORRESPONDING TO SECTION FROM REGISTER AND AUTOMATICALLY SET IT
SD9
AUTOMATIC ACCOMPANIMENT REPRODUCTION MODE ?
NO
YES
SD10
READ ACCOMPANIMENT STYLE DATA OF SELECTED REPRODUCTION SECTION AT PRESENT TIMING FROM WORKING AREA AND CONVERT ITS PITCH IN ACCORDANCE WITH DESIGNATED CHORD TO REPRODUCE IT
NO
SECTION AUTOMATIC SWITCHING TIMING ?
SD11
YES
SD12
ENDING SECTION OR END TIMING ?
NO
YES
SD13
YES
STOP SWITCH OPERATED ?
NO
SD14
STOP AUTOMATIC ACCOMPANIMENT REPRODUCTION MODE
SD15
MANUAL PERFORMANCE PROCESS
SD16
OTHER PROCESSES

AUTOMATIC ACCOMPANIMENT APPARATUS AND A STORAGE DEVICE STORING A PROGRAM FOR OPERATING THE SAME

CROSS REFERENCE TO RELATED APPLICATION

This is a continuation of application Ser. 10/091,814, filed Mar. 4, 2002 now U.S. Pat. No. 6,852,918.

BACKGROUND OF THE INVENTION

A) Field of the Invention

The present invention relates to an automatic accompaniment apparatus, and more particularly to an automatic accompaniment apparatus capable of editing accompaniment style data.

B) Description of the Related Art

A user of an automatic musical performance apparatus plays only a melody line, and makes the apparatus reproduce accompaniment style data which is accompaniment data stored in the apparatus, by designating the accompaniment style data.

Accompaniment style data is prepared generally for each accompaniment style for each combination of such as type of rhythm, music genre and tempo. Each accompaniment style data has a plurality of sections matching the image of music, such as intro, main, fill-in and ending.

Each section is constituted of a plurality of tracks such as a chord track, a base track and a drum (rhythm) track.

Some conventional automatic accompaniment apparatuses store preset accompaniment data of a plurality of tracks for each accompaniment style. When user accompaniment data is to be generated, an accompaniment style for each track is designated and stored so that the user accompaniment data can be generated easily.

With a conventional automatic accompaniment apparatus, since all tracks are created by preset accompaniment data, it is difficult to have originality of the accompaniment data although the accompaniment style for each track can be designated and stored.

For example, designating the accompaniment style in the unit of section of accompaniment data having a plurality of sections has not been taken into consideration. It is difficult to generate accompaniment patterns having the same accompaniment data part and only different chord conversion characteristics, accompaniment patterns having only different panel setting information such as manual performance setting, and accompaniment patterns having only different settings such as the volume and effects of each track.

If additional sounds of manual performance or pad performance information are included in the panel setting information, it is difficult for different musical instruments to use accompaniment style data because there is no setting compatibility between the pad performance and the additional sounds of each musical instrument which reproduces the accompaniment style data.

SUMMARY OF THE INVENTION

It is an object of the present invention to provide an automatic performance apparatus capable of easily generating derivative accompaniment style data from original accompaniment style data.

It is another object of the invention to provide an automatic performance apparatus capable of generating derivative accompaniment style data having originality even from derivative accompaniment style data.

It is another object of the present invention to provide an automatic accompaniment apparatus capable of using accompaniment data by different musical instruments even if there is no setting compatibility between pad performance and additional sounds of each musical instrument which reproduces accompaniment data.

According to one aspect of the present invention, there is provided an automatic accompaniment apparatus comprising: storage unit for storing accompaniment style data including basic accompaniment data for automatic accompaniment and replacement accompaniment data to be reproduced in place of the basic accompaniment data; and reproducing unit for reading the stored accompaniment style data and reproducing the read accompaniment style data, said reproducing unit reproducing the read accompaniment style data by replacing a portion of said basic accompaniment data with the replacement accompaniment data.

According to another aspect of the present invention, there is provided an automatic accompaniment apparatus comprising: storage unit for storing accompaniment style data including accompaniment data for automatic accompaniment, basic chord conversion information for chord conversion of the accompaniment data, and replacement chord conversion information to be reproduced in place of the basic chord conversion information; and reproducing unit for replacing a portion of the basic chord conversion information with the replacement chord conversion information and reading and reproducing the stored accompaniment style data in accordance with the basic chord conversion information whose portion was replaced with the replacement chord conversion information.

According to another aspect of the present invention, there is provided an automatic accompaniment apparatus comprising: input unit for inputting performance information; storage unit for storing accompaniment style data including accompaniment data for automatic accompaniment and panel setting information for controlling a style of a musical tone to be generated in accordance with the performance information, the panel setting information including musical tone type designating information for designating a musical tone type to be assigned to said input unit by using a bank number and a program number; reproducing unit for reading the stored accompaniment style data and reproducing the read accompaniment style data; and musical tone generating unit for generating a musical tone of a type designated by the musical tone type designating information contained in the accompaniment style data to be reproduced by said reproducing unit, in accordance with the performance information.

According to another aspect of the present invention, there is provide an automatic accompaniment apparatus comprising: input unit for inputting performance information; storage unit for storing accompaniment style data including accompaniment data for automatic accompaniment and panel setting information for controlling a style of a musical tone to be generated in accordance with the performance information, the panel setting information including harmony tone type designating information for designating a harmony tone type to be added to the performance information by using a bank number and a program number; reproducing unit for reading the stored accompaniment style data and reproducing the read accompaniment style data; and musical tone generating unit for adding the performance information with a harmony tone signal of a type designated by the harmony tone type designating information contained in the accompaniment style data to be reproduced by said reproducing unit and generating a musical tone signal of the performance information and the harmony tone signal to be added.

According to another aspect of the present invention, there is provided a program for making a computer execute an automatic accompaniment process, the process comprising: a step of reading an accompaniment style data from storage unit for storing the accompaniment style data including basic accompaniment data for automatic accompaniment and replacement accompaniment data to be reproduced in place of the basic accompaniment data; and a step of reproducing the read accompaniment style data, said reproducing step reproducing the read accompaniment style data by replacing a portion of the basic accompaniment data with the replacement accompaniment data.

As above, it is possible to provide an automatic performance apparatus capable of easily generating derivative accompaniment style data from original accompaniment style data.

It is also possible to provide an automatic performance apparatus capable of generating derivative accompaniment style data having originality even from derivative accompaniment style data.

It is also possible to provide an automatic accompaniment apparatus capable of using accompaniment data of a different musical instrument even if there is no setting compatibility in pad performance and/or additional sounds between the musical instruments.

BRIEF DESCRIPTION OF THE DRAWINGS

FIG. 8 is a table used for designating the type of a pad contained in the panel setting information.

FIG. 9 is a table used for designating the type of harmony contained in the panel setting information.

FIG. 11 is a flow chart illustrating an automatic accompaniment process to be executed by CPU 5 shown in FIG. 1.

DESCRIPTION OF THE PREFERRED EMBODIMENTS

Figure 1:
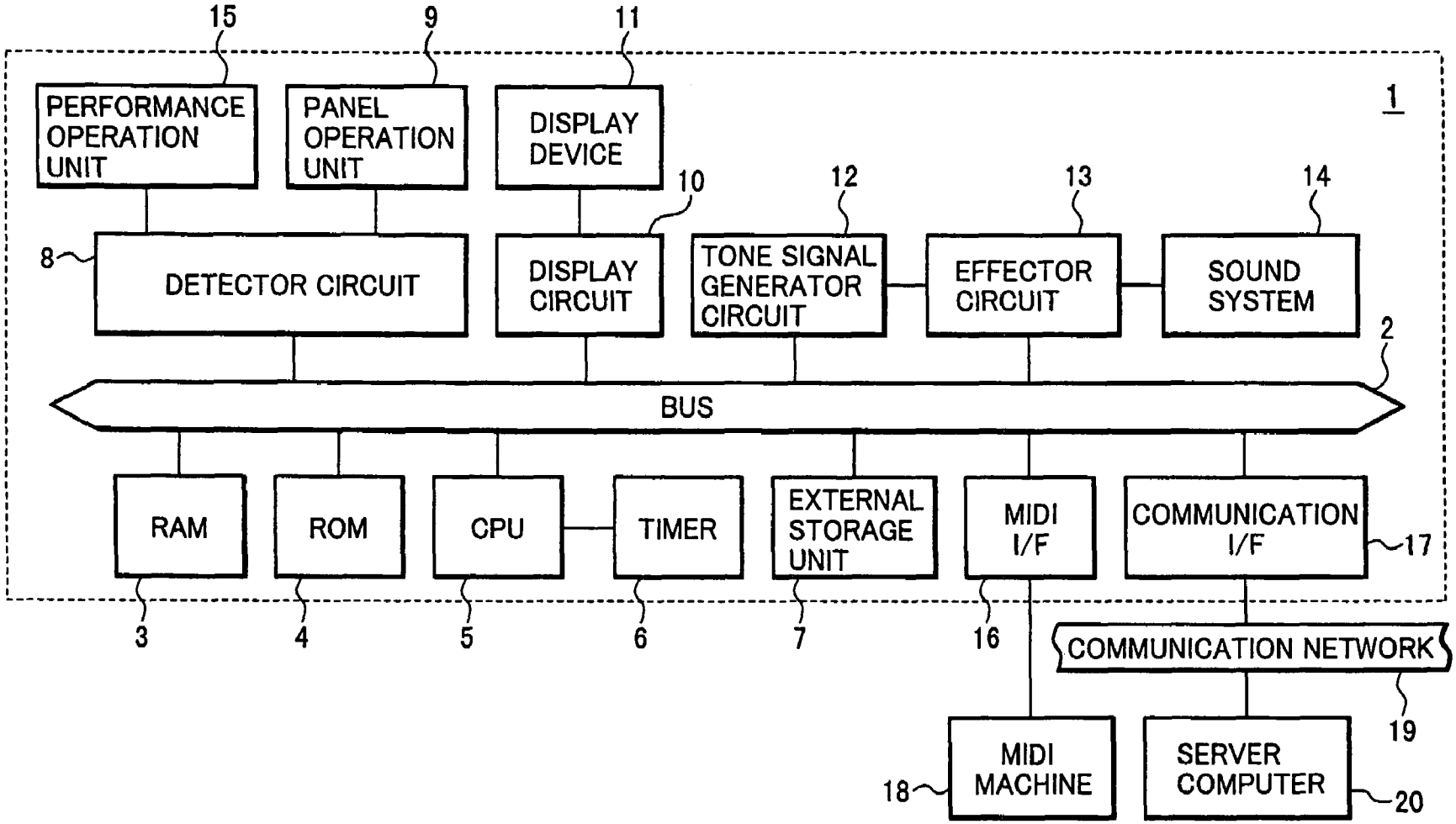
FIG. 1 is a block diagram showing the hardware structure of an automatic accompaniment apparatus according to an embodiment of the invention.

FIG. 1 is a block diagram showing the hardware structure of an automatic accompaniment apparatus 1 according to an embodiment of the invention.

The automatic accompaniment apparatus 1 has a bus 2, a RAM 3, a ROM 4, a CPU 5, a timer 6, an external storage unit 7, a detector circuit 8, a panel operation unit 9, a display circuit 10, a display device 11, a tone signal generator circuit 12, an effector circuit 13, a sound system 14, a performance operation unit 15, a MIDI interface 16, and a communication interface 17.

The RAM 3, ROM 4, CPU 5, external storage unit 7, detector circuit 8, display circuit 10, tone signal generator circuit 12, effector circuit 13, MIDI interface 16, and communication interface 17 are interconnected by the bus 2.

A user can set various settings by using the panel operation unit 9 connected to the detector circuit 8. The operation unit 9 may be of any type so long as it can output a signal corresponding to a user input, such as rotary enchordr, switch, pad, fader, slider, mouse, alphanumeric keyboard, musical performance keyboard, joy stick and joggle shuttle.

In this embodiment, the panel operation unit 9 is used for a user to enter various settings, selections, start and stop of automatic performance and the like during each of various processes to be described later.

The panel operation unit 9 may be software switches displayed on the display device 11 and operated by another operation unit such as a mouse.

The display circuit 10 is connected to the display device 11 which displays various information. By referring to the information displayed on the display device 11, the user enters various settings. The display device 11 is made of, for example, a liquid crystal display (LCD), light emitting diodes (LED) or the like. The display device 11 may be an external display device connected to the automatic accompaniment apparatus.

A touch panel may be used as the display device 11. In this case, a user depresses a switch or the like displayed on the display device 11 to enter user instructions.

The external storage unit 7 has an interface via which it is connected to the bus 2. The external storage unit 7 may be a floppy disc drive (FDD), a hard disc drive (HDD), a magneto optical (MO) disc drive, a compact disc read-only memory (CD-ROM) drive, a digital versatile disc (DVD) drive or a semiconductor memory card.

The external storage unit 7 can store various parameters, various data, programs realizing the embodiment functions, and the like. In this embodiment, the external storage unit 7 stores a plurality of automatic accompaniment style data sets as preset data or user data.

RAM 3 has working areas of CPU 5 storing various parameters, such as flags, registers and buffers. ROM 4 can store various parameters and control programs, and programs for realizing the embodiment functions. These programs are not necessary to be stored in duplicate in the external storage unit 7. CPU 5 performs calculations and controls in accordance with the control programs stored in ROM 4 or in the external storage unit 7.

The timer 6 connected to CPU 5 supplies CPU 5 with base clock signals, interrupt timings and the like.

If HDD is connected as the external storage unit 7, the control programs, the programs for realizing the embodiment functions and the like may be stored in a hard disc of the external storage unit 7. If the control programs and the like are read from the hard disc into RAM3, CPU 5 can perform operations in a manner similar to the case that the control programs and the like are stored in ROM 4. In this case, addition, version-up and the like of the control programs and the like can be made easy.

If a CD-ROM drive in addition to the hard disc drive is connected, the control programs, the programs for realizing the embodiment functions and the like may be stored in CD-ROM. The control programs, the programs for realizing the embodiment functions and the like can be copied from CD-ROM to the hard disc. In this case, new installation and version-up of the control programs and the like can be made easy.

The tone generator circuit 12 generates tone signals corresponding to sequence data recorded in the external storage unit 7 or the like, or to MIDI signals, performance signals or the like supplied from a MIDI instrument 18 or the like connected to the MIDI interface, and supplies the tone signals to the sound system 14 via the effector circuit 13.

The effector circuit 13 gives various effects to the digital tone signal supplied from the tone signal generator circuit 12.

The sound system 14 includes a D/A converter and speakers, and converts supplied digital tone signals into analog tone signals to produce sounds.

The tone signal generator circuit 12 may be of any type such as a waveform memory type, an FM type, a physical model type, a harmonics synthesizer type, a formant synthesizer type, and an analog synthesizer type of voltage controlled oscillator (VCO)+voltage controlled filter (VCF)+voltage controlled amplifier (VCA).

The tone signal generator circuit 12 is not limited only to dedicated hardware, but it may be configured by a digital signal processor (DSP) and microprograms, by a CPU and software programs, or by a sound card.

A single tone signal generator circuit may be used time divisionally to form a plurality of sound channels, or a plurality of tone signal generator circuits may by used to form a plurality of sound channels one channel per each tone signal generator circuit.

The performance operation unit 15 is connected to the detector circuit 8 to supply performance signals in accordance with a user performance. In this embodiment, a musical performance keyboard and pads are used as the performance operation unit 15. The performance operation unit 15 are not limited only thereto, but any unit may be used so long as a user can enter performance information. For example, an alphanumerical keyboard, a mouse, or a joy stick may be used as the performance operation unit 15.

The MIDI interface (MIDI I/F) 16 is connectable to an electronic musical instrument, other musical instruments, an acoustic machine, a computer or the like. MIDI I/F 16 can input and output at least MIDI signals. MIDI I/F 16 is not limited only to a dedicated MIDI interface, but it may be a general interface such as RS-232C, universal serial bus (USB) and IEEE1394 (I triple E 1394). Data other than MIDI messages may be transmitted or received at the same time when MIDI messages are transferred.

The MIDI machine 18 is an acoustic machine, a musical instrument or the like connected to MIDI I/F 16. The MIDI machine 18 is not limited only to a keyed instrument, but is may be of a stringed type, a wind type and a percussion type. The MIDI machine may be of an integrated type having a tone signal generator, an automatic performance apparatus and the like built in the machine, or of a discrete type with components connected by communication means such as MIDI network and other networks. By playing (operating) the MIDI machine 18, the user may enter performance information.

The MIDI machine 18 may be used as an operation unit for entering various settings and information other than performance information.

The communication interface 17 is connectable to the communication network 19 such as a local area network (LAN), the Internet and telephone line. The control programs, the programs realizing the embodiment functions, accompaniment style data and the like can be downloaded from a server computer 20 connected to the network 19 into the external storage unit 7 such as HDD, or RAM 3.

The communication interface 17 and communication network 19 may be of either a wired type or a wireless type, or may have both types.

Figure 2:
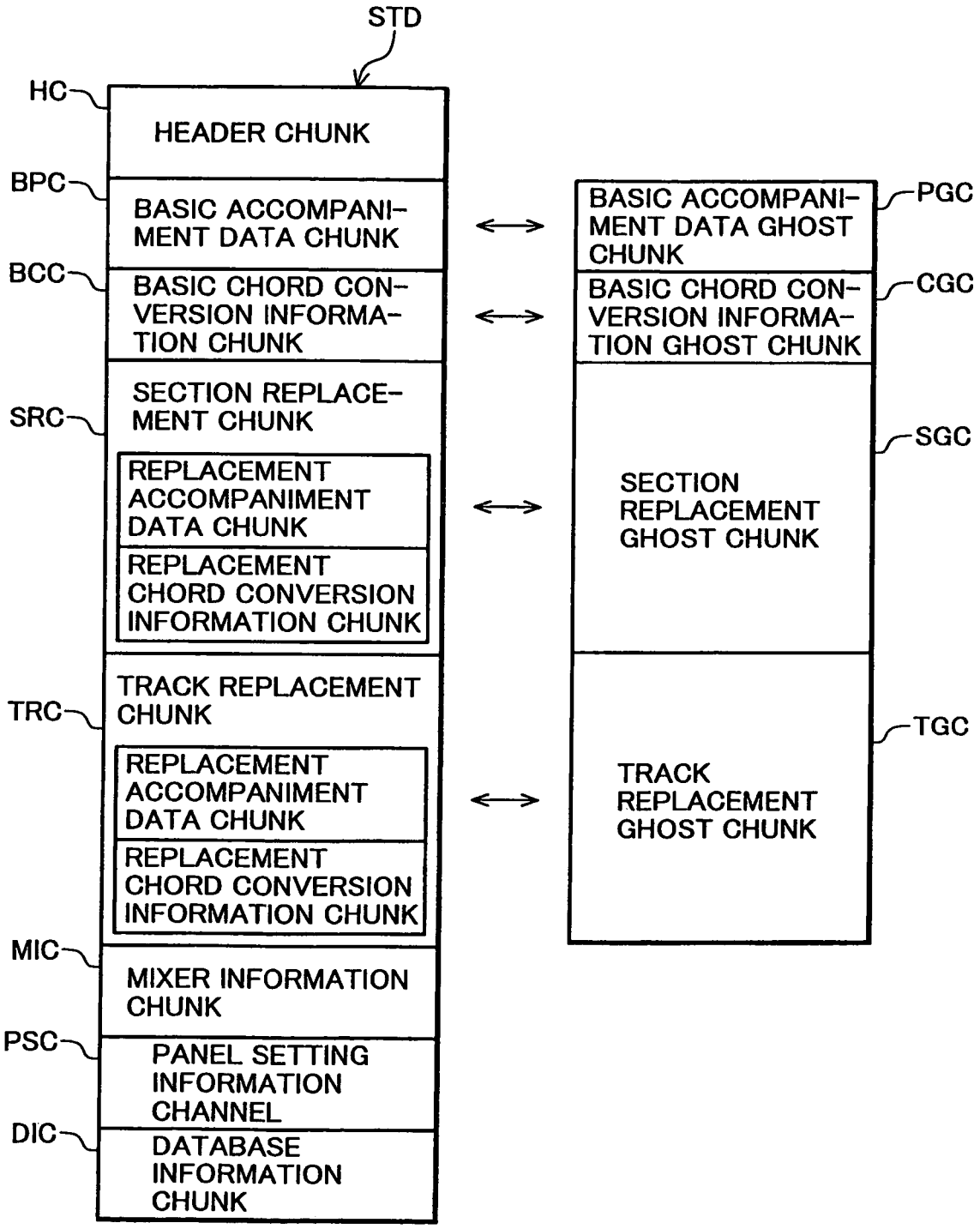
FIG. 2 is a conceptual diagram showing the format of accompaniment style data STD according to the embodiment.

FIG. 2 is a conceptual diagram showing the format of accompaniment style data STD according to the embodiment. The accompaniment style data STD is automatic performance data in conformity with, for example, the standard MIDI file (SMF) format. Data of the SMF format is constituted of one header chunk HC and one or more data groups called chunks.

In this embodiment, the accompaniment style data STD has the header chunk HC and at least one or more chunks selected from a basic accompaniment data chunk BPC, a basic chord conversion information chunk BCC, a section replacement chunk SRC, a track replacement chunk TRC, a mixer information chunk MIC, a panel setting information chunk PSC, and a database information chunk DIC.

The header chunk HC stores a data format type (SMF format 0, 1 or the like), a chunk configuration (the number of chunks and the like) and the like.

The basic accompaniment data chunk BPC stores basic accompaniment data (before replacement) of a plurality of tracks (chord backing, base, rhythm and the like) of each of a plurality of sections (intro, main, fill-in, ending and the like).

The accompaniment data of each track excepting the rhythm track stored in the basic accompaniment data chunk BPC is generated in accordance with a predetermined chord. This chord is converted into a chord designated before musical performance. For example, the predetermined chord is C major, and the pitch of accompaniment data is converted so as to match the chord designated before musical performance. The predetermined chord for the accompaniment data may be fixed or may be variable.

The basic accompaniment data chunk BPC stores the accompaniment data of one or a plurality of measures different for each section.

The basic chord conversion chunk BCC stores information to be used for chord conversion of basic accompaniment data. Namely, it stores a table or the like to be used for setting the characteristics of chord conversion. The basic chord conversion information chunk BCC is prepared for each section.

The section replacement chunk SRC stores data to be replaced with the basic accompaniment data or chord conversion information of some section (e.g., intro). The section replacement chunk SRC includes a replacement accompaniment data chunk and a replacement chord conversion information chunk.

If the section replacement chunk SRC exists, data in the basic accompaniment data chunk BPC of the corresponding section and data in the basic chord conversion information chunk BCC of the corresponding section are neglected and the contents of the section replacement chunk SRC are reflected. Only by adding the section replacement chunk SRC, parts of the basic accompaniment data and basic chord conversion information can be altered easily without destroying the basic accompaniment data and basic chord conversion information.

The track replacement chunk TRC stores data to be replaced with the basic accompaniment data or chord conversion information of some track (e.g., base) of some section (e.g., main). The track replacement chunk TRC includes both a replacement accompaniment data chunk and a replacement chord conversion information chunk.

Similar to the section replacement chunk SRC, the track replacement chunk TRC can alter parts (in the unit of track) of the basic accompaniment data and basic chord conversion information.

The section of the track replacement chunk TRC may be the same section of the section replacement chunk SRC. In this case, only the track designated by the track replacement chunk TRC follows the designation by the track replacement chunk TRC, and other tracks follow the designation by the section replacement chunk SRC.

The mixer information chunk MIC stores mixer information (setting change information such as sound volume, effects and tone color) of each section and each track. With this mixer information chunk MIC, parameters such as sound volumes, effects and tone colors in the basic accompaniment data can be altered without destroying them.

If the accompaniment style data has such mixer information for altering setting information such as sound volumes and effects, accompaniment patterns with only the altered settings such as sound volumes and effects can be generated easily.

The panel setting information channel PSC stores one set or a plurality set of various panel setting information (settings such as sound volumes, effects and automatic accompaniment entered by operating the performance operation unit). With this panel setting information chunk PSC, the optimum panel setting state for each accompaniment style can be obtained.

If a plurality set of panel setting information are stored in the panel setting information chunk PSC, the optimum panel setting state for each section can be obtained.

By adding the panel setting information to the accompaniment style data, accompaniment patterns with only the altered panel setting information such as manual performance setting information can be obtained easily.

As will be later described, a plurality set of panel setting information is provided and each panel setting information is made in correspondence with a plurality of sections. Panel setting information can be altered automatically in response to switching of each section.

The database information chunk DIC stores information to be stored in a music database (capable of checking whether each accompaniment style data is suitable for what music program or genre).

For example, the database information chunk DIC stores the music title and genre name matching the image of each accompaniment style, a keyword associated with the image of each accompaniment style, and the like.

The ghost chunk may include a basic accompaniment data ghost chunk (PGC), a basic chord conversion information ghost chunk (CGC), a section replacement ghost chunk (SGC) and a track replacement ghost chunk (TGC). The ghost chunk stores a path to a corresponding chunk of another accompaniment style data (e.g., Path:¥drive name¥folder name¥file name) and does not store real data or information (i.e., entities).

By using the ghost chunk, the same contents of a chunk of another accompaniment style data can be used at a smaller memory capacity and data and information can be partially replaced.

Both the section replacement chunk SRC and track replacement chunk TRC are not required to be provided, but one of them may be provided or none of them may be provided. If both the chunks SRC and TRC are not provided, the accompaniment style data contains only the basic accompaniment data.

A plurality of section replacement chunks SRC and track replacement TRC chunks may be provided. The ghost chunk may or may not be provided. The mixer information is effective also for the ghost chunk, and the mixer information is added to the accompaniment style data at the path represented by the ghost chunk.

Figure 3A:
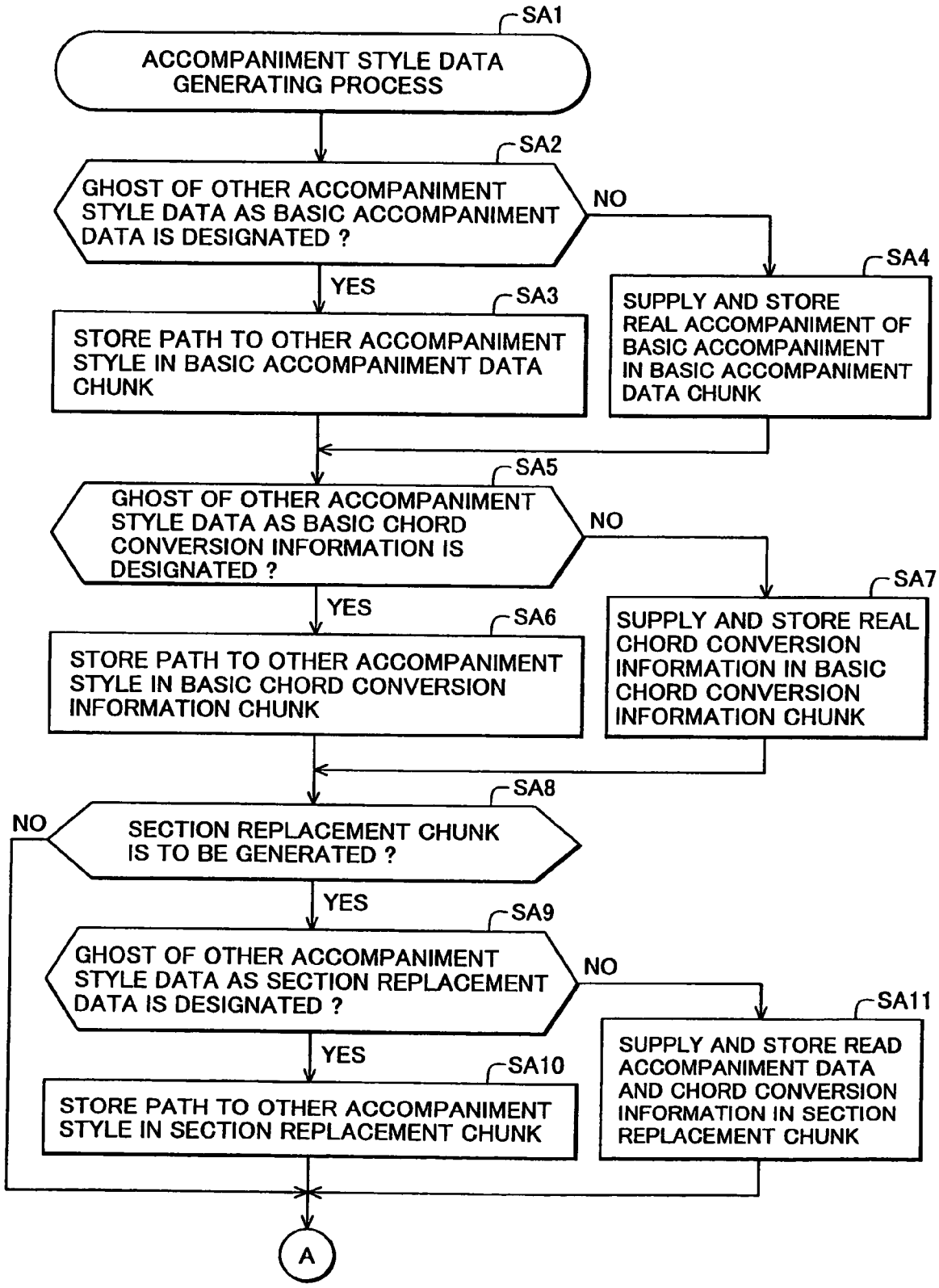
FIGS. 3A and 3B are flow charts illustrating an accompaniment data generating process to be executed by CPU 5 shown in FIG. 1.
Figure 3B:
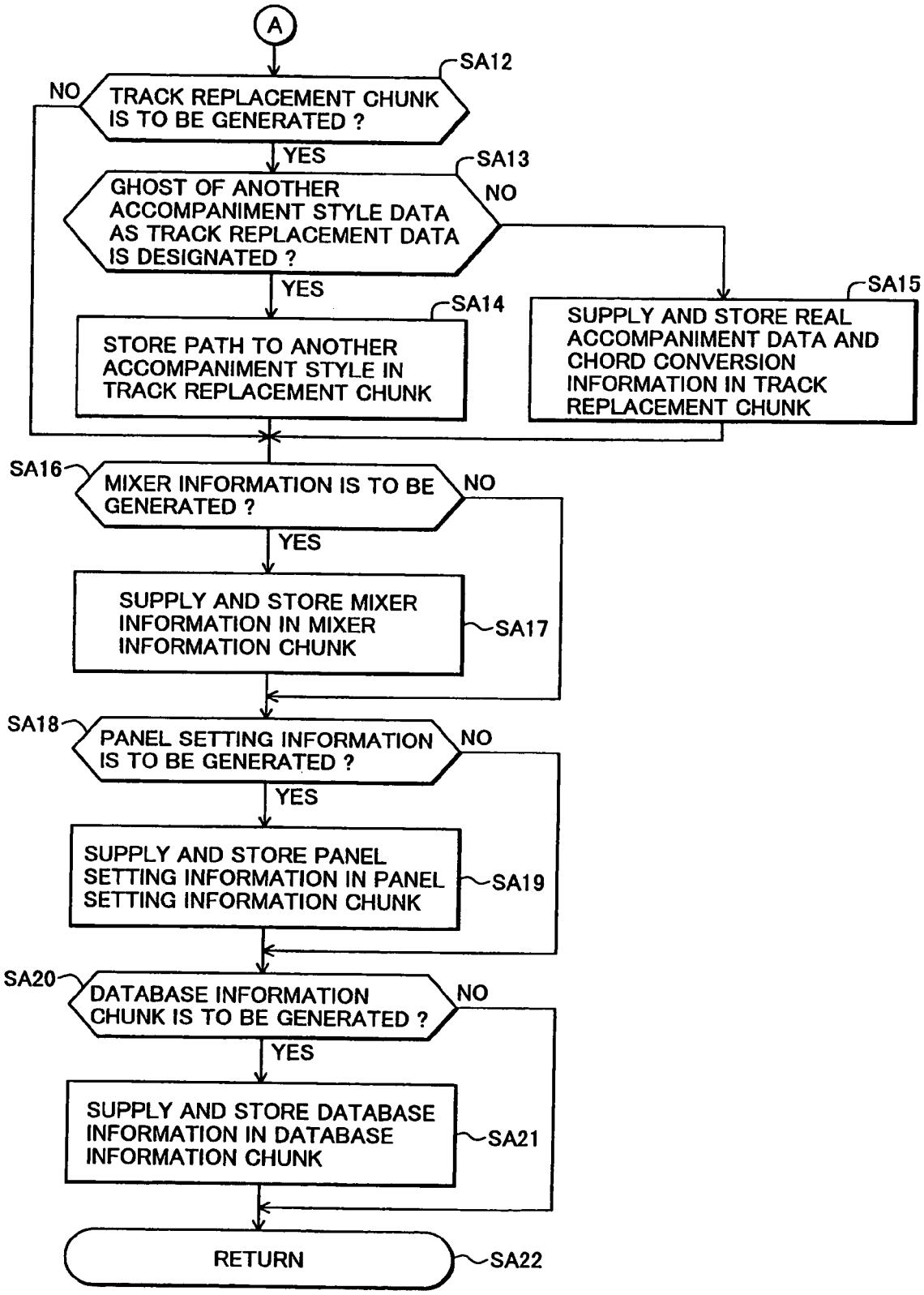

FIGS. 3A and 3B are flow charts illustrating an accompaniment style data generating process to be executed by CPU 5 shown in FIG. 1. During this accompaniment style data generating process, a user refers to the information displayed on the display device 11 shown in FIG. 1 and enters various information and settings by using the panel operation unit 9.

Data and information are supplied (input) by a user by using the panel operation unit 9, performance operation unit 15 or MIDI machine 18 connected to the MIDI interface 16.

Data or information already existing in the external storage unit 7 or the like may be stored as the accompaniment style data in the chunks. Data or information may be downloaded from the server computer 20 via the communication I/F 17 and communication network 19.

At Step SA1 the accompaniment style data generating process starts to thereafter advance to the next Step SA2.

At Step SA2 a user is confirmed whether a ghost of another accompaniment style data is designated as the basic accompaniment data. If the ghost of another accompaniment style data is designated, the flow advances to Step SA3 indicated by a YES arrow, whereas if not, i.e., if real accompaniment data is to be input, the flow branches to Step SA4 indicated by a NO arrow.

At Step SA3 the path to another accompaniment style designated by the user is stored in the basic accompaniment data chunk BPC. Thereafter, the flow advances to Step SA5.

At Step SA4 the real accompaniment data of the basic accompaniment is supplied and stored in the basic accompaniment data chunk BPC. After the read accompaniment data is stored, the flow advances to Step SA5.

At Step SA5 the user is confirmed whether the ghost of another accompaniment style data is designated as the basic chord conversion information. If the ghost of another accompaniment style data is designated, the flow advances to Step SA6 indicated by a YES arrow, whereas if not, i.e., if chord conversion information is to be input, the flow branches to Step SA7 indicated by a NO arrow.

At Step SA6 the path to the other accompaniment style designated by the user is stored in the basic chord conversion information chunk BCC to thereafter advance to Step SA8.

At Step SA7 the chord conversion information is supplied and stored in the basic chord conversion information chunk BCC. After this chord conversion information is stored, the flow advances to Step SA8.

At Step SA8 the user is confirmed whether the section replacement chunk SRC is generated. If the section replacement chunk SRC is to be generated, the flow advances to Step SA9 indicated by a YES arrow, whereas if not, the flow skips to Step SA12 indicated by a NO arrow and shown in FIG. 3B.

At Step SA9, the user is confirmed whether the ghost of another style data is designated as the section replacement data. If the ghost of the other accompaniment style data is to be designated, the flow advances to Step SA10 indicated by a YES arrow, whereas if not, i.e., if the section replacement data is to be input, the flow branches to Step SA11 indicated by a NO arrow.

At Step SA10 the path to the other accompaniment style designated by the user is stored in the section replacement chunk SRC. Thereafter, the flow advances to Step SA12 shown in FIG. 3B.

At Step SA11 both or one of the real accompaniment data and chord conversion information is supplied and stored in the section replacement chunk SRC. Thereafter, the flow advances to Step SA12 shown in FIG. 3B.

FIG. 3B is a flow chart illustrating the accompaniment style data generating process which follows the process shown in FIG. 3A.

At Step SA12 the user is confirmed whether the track replacement chunk TRC is generated. If the track replacement chunk TRC is to be generated, the flow advances to Step SA13 indicated by a YES arrow, whereas if not, the flow skips to Step SA16 indicated by a NO arrow.

At Step SA13 the user is confirmed whether the ghost of another accompaniment style data is designated as the track replacement data. If the ghost of another accompaniment data is to be designated, the flow advances to Step SA14 indicated by a YES arrow, whereas if not, i.e., if the track replacement data is to be input, the flow branches to Step SA15 indicated by a NO arrow.

At Step SA14 the path to the other accompaniment style designated by the user is stored in the track replacement chunk TRC to thereafter advance to Step SA16.

At Step SA15 both or one of the real accompaniment data and chord conversion information is supplied and stored in the track replacement chunk TRC to thereafter advance to Step SA16.

At Step SA16 the user is confirmed whether the mixer information chunk MIC is generated. If the mixer information chunk MIC is to be generated, the flow advances to Step SA17 indicated by a YES arrow, whereas if not, the flow skips to Step SA18.

At Step SA17 the mixer information is supplied and stored in the mixer information chunk MIC to thereafter advance to Step SA18.

At Step SA18 the user is confirmed whether the panel setting information chunk PSC is generated. If the panel setting information chunk PSC is to be generated, the flow advances to Step SA19 indicated by a YES arrow, whereas if not, the flow skips to Step SA20 indicated by a NO arrow.

At Step SA19 the panel setting information is supplied and stored in the panel setting information chunk PSC to thereafter advance to Step SA20.

At Step SA20 the user is confirmed whether the database information chunk DIC is generated. If the database information chunk DIC is to be generated, the flow advances to Step SA21, whereas if not, the flow skips to Step SA22 indicated by a NO arrow.

At Step SA21 the database information is supplied and stored in the database information chunk DIC to thereafter advance to Step SA22.

At Step SA22 the accompaniment style data generating process is terminated.

Figure 4A:
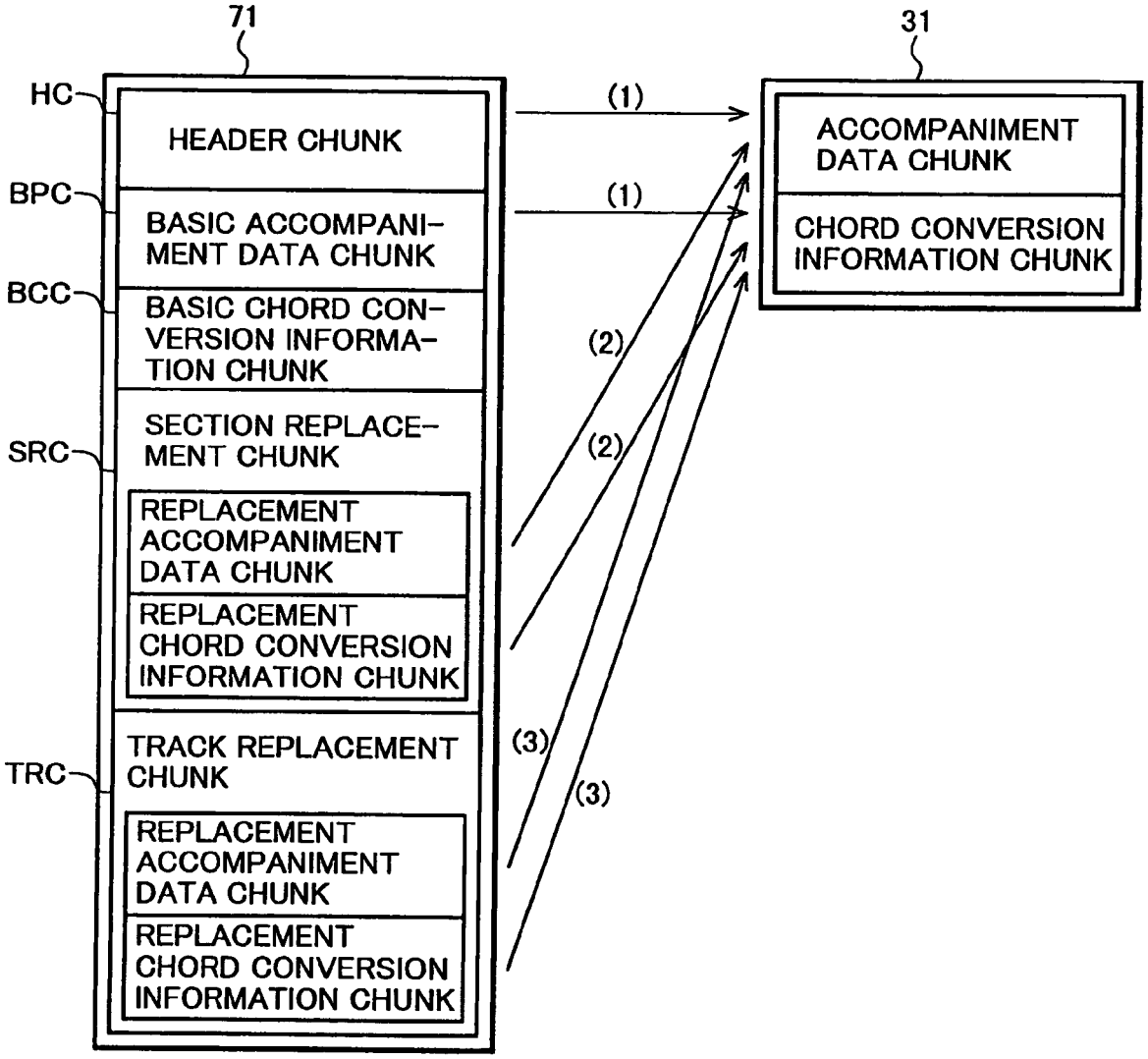
FIGS. 4A and 4B are conceptual diagrams showing data flow during accompaniment style data reproduction.
Figure 4B:
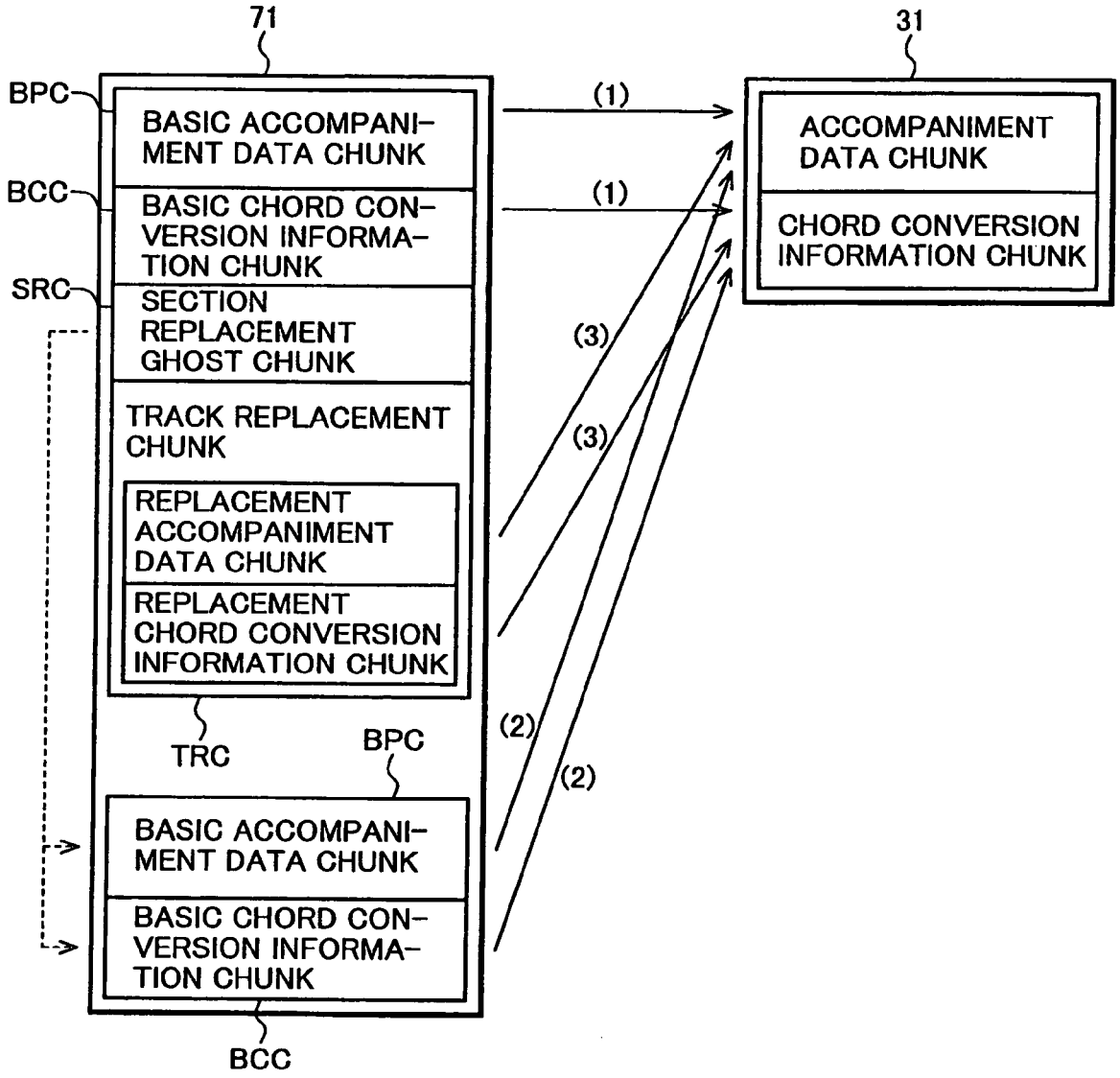

FIGS. 4A and 4B are conceptual diagrams illustrating the data flow when accompaniment style data is reproduced. Numerals in the parentheses given to arrows indicate the order of reading data from an accompaniment style data storage area 71 of the external storage unit 7 such as a flash memory, a floppy disc and HDD into an accompaniment style data reproduction working area 31 of RAM 3.

FIG. 4A shows the case that the accompaniment style data does not contain a ghost chunk.

First, the basic accompaniment data and basic chord conversion information are copied from the storage area 71 to the working area 31. Next, the accompaniment data and chord conversion information of a section designated by the section replacement chunk SRC are overwritten and copied from the storage area 71 to the working area 31. The basic accompaniment data and basic chord conversion information of the designated section in the working area 31 are therefore overwritten by the replacement accompaniment data and replacement chord conversion information.

Lastly, the accompaniment data and chord conversion information of the track of the section designated by the track replacement chunk TRC are overwritten and copied from the storage area 71 to the working area 31. The accompaniment data and chord conversion information of the designated track of the designated section in the working area 31 are therefore overwritten by the replacement accompaniment data and replacement chord conversion information.

FIG. 4B shows the case that the accompaniment style data contains a ghost chunk.

First, the basic accompaniment data and basic chord conversion information are copied from the storage area 71 to the working area 31.

Next, by referring to the accompaniment style data stored at the path designated by the section replacement ghost chunk SGC, the basic accompaniment data and basic chord conversion information of a designated section are overwritten and copied from the storage area 71 to the working area 31.

Lastly, the accompaniment data and chord conversion information of the track of the section designated by the track replacement chunk TRC are overwritten and copied from the storage area 71 to the working area 31. The accompaniment data and chord conversion information of the designated track of the designated section in the working area 31 are therefore overwritten by the replacement accompaniment data and replacement chord conversion information.

Figure 5:
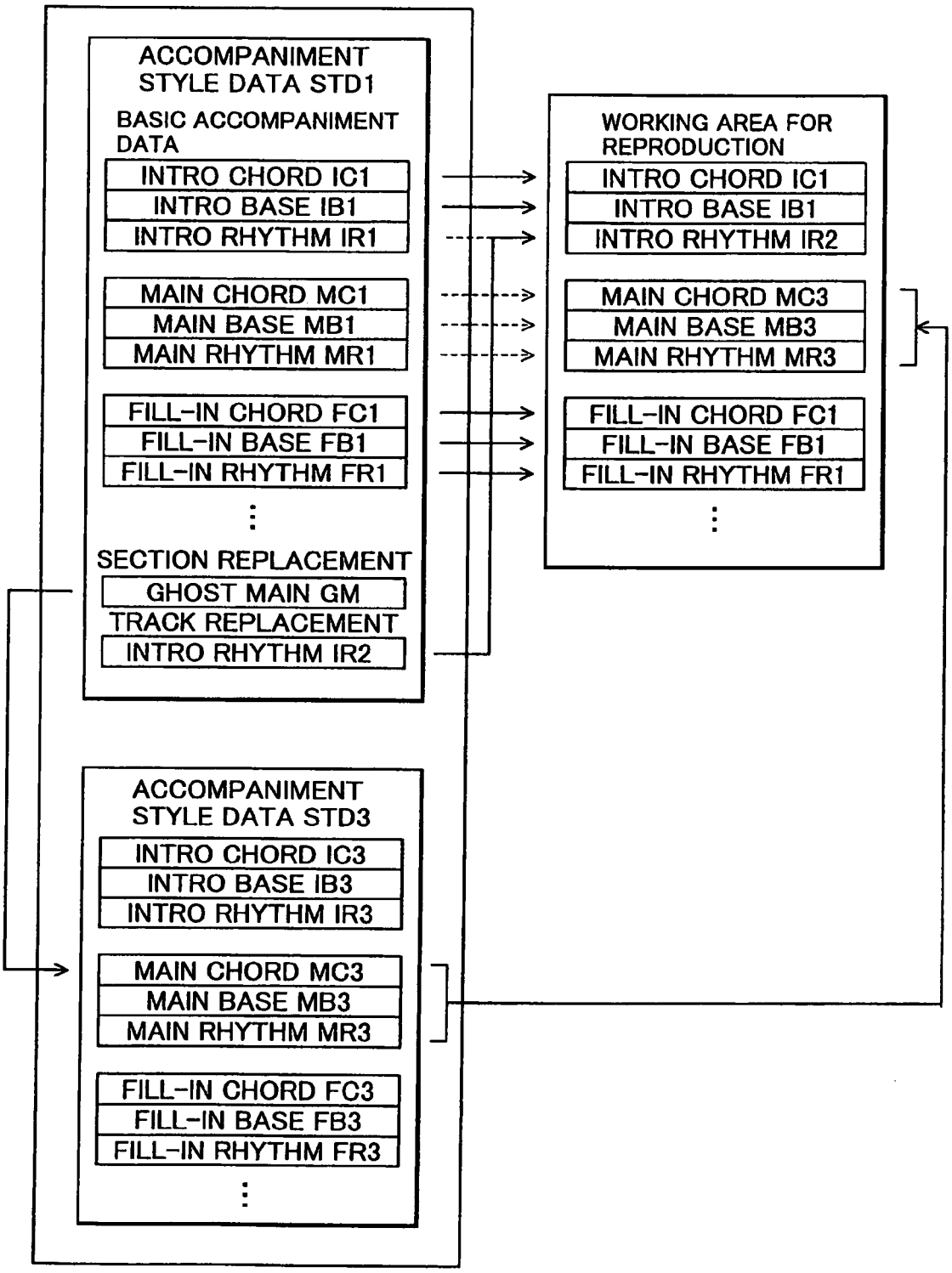
FIG. 5 is a conceptual diagram showing final data in a working area 31 if accompaniment style data contains a ghost chunk.

FIG. 5 is a conceptual diagram showing the final data in the working area 31 if the accompaniment style data contains a ghost chunk.

The original accompaniment style data STD1 to be reproduced contains the basic accompaniment data for the chord, base and rhythm tracks of the intro section, i.e., intro chord IC1, intro base IB1 and intro rhythm IR1.

Similarly, the accompaniment style data STD1 also contains main chord MC1, main base MB1 and main rhythm MR1 respectively of the main section.

Similarly, the accompaniment style data STD1 also contains fill-in chord FC1, fill-in base FB1 and fill-in rhythm FR1 respectively of the fill-in section.

The accompaniment style data STD1 also stores ghost main GM or the section replacement chunk as the section replacement data. The ghost main GM stores a path to the main section of accompaniment style data STD3.

The accompaniment style data STD1 also stores intro rhythm IR2 as the track replacement data for the rhythm track of the intro section.

In reproducing the accompaniment style data STD1, first the intro chord IC1, intro base IB1, intro rhythm IR1, main chord MC1, main base MB1, main rhythm MR1, fill-in chord FC1, fill-in base FB1, and fill-in rhythm FR1 are copied from the storage area 71 to the working area 31.

Thereafter, the main chord MC3, a main base MB3 and a main rhythm MR3 are overwritten and copied from the main section of the accompaniment style data STD3 designated by the ghost main GM to the working area 31.

Lastly, the intro rhythm IR2 is overwritten and copied to the working area 31. The final contents of the working area 31 are those shown in FIG. 5.

The accompaniment style data to be reproduced is the data stored in the working area 31. During reproduction, for example, the replaced intro rhythm IR2 is reproduced for the rhythm track of the intro section, and the main chord MC3, main base MB3 and main rhythm MR3 copied from the main section of the accompaniment style data STD3 are reproduced for the tracks of the main section.

By using the ghost chunk, the data stored in a different storage area is not necessary to be stored in duplicate so that the storage area 71 can be used efficiently.

Since the replacement data is overwritten and copied to the working area 31, the basic accompaniment data and the like in the accompaniment style data are not altered. The accompaniment style data can be altered without destroying the original data.

If the original accompaniment data is to be recovered, the replacement data chunk and ghost chunk are deleted.

Figure 6A:
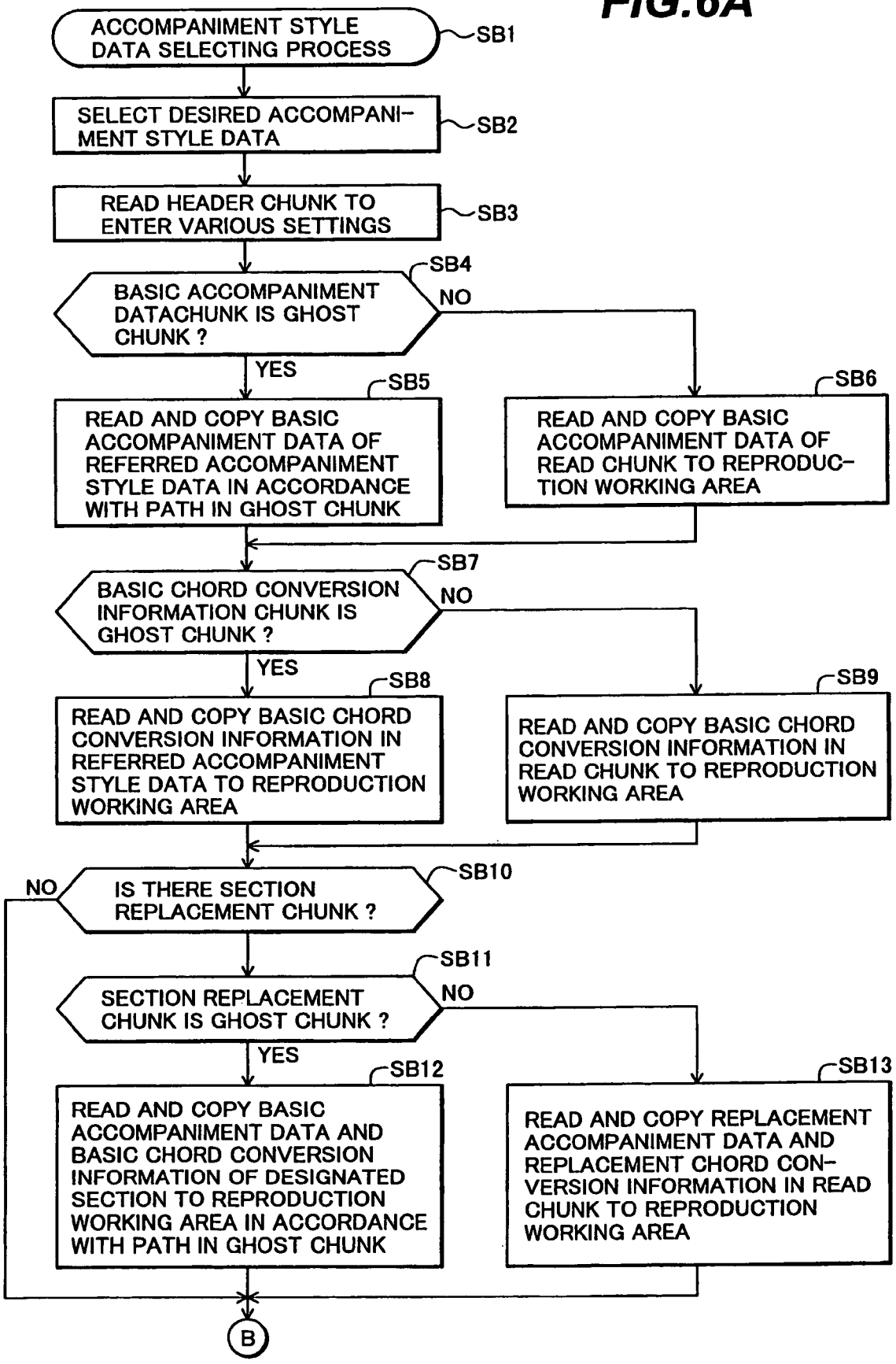
FIGS. 6A and 6B are flow charts illustrating an accompaniment style data selecting process to be executed by CPU 5 shown in FIG. 1.

FIG. 6A is a flow chart illustrating an accompaniment style data selecting process to be executed by CPU 5 shown in FIG. 1. A user enters various settings, selections and information by using the panel operation unit 9 or the like shown in FIG. 1.

At Step SB1 the accompaniment style data selecting process starts to thereafter advance to Step SB2.

At Step SB2 in accordance with a user instruction, desired accompaniment style data is selected to thereafter advance to the next Step SB3.

At Step SB3 the header chunk HC of the accompaniment style data selected at Step SB2 is read to enter various settings and thereafter advance to the next Step SB4.

At Step SB4 the basic accompaniment data chunk BPC of the selected accompaniment style data is read to judge whether the read chunk is a ghost chunk. If the read chunk is a ghost chunk, the flow advances to Step SB5 indicated by a YES arrow, whereas if not, the flow branches to Step SB6 indicated by a NO arrow.

At Step SB5 in accordance with the path stored in the ghost chunk, the basic accompaniment data in the referred accompaniment style data is read and copied to the reproduction working area 31 in RAM 3. Thereafter, the flow advances to Step SB7.

At Step SB6 the basic accompaniment data in the read chunk is read and copied to the working area 31. Thereafter, the flow advances to Step SB7.

At Step SB7 the basic chord conversion information chunk BCC of the selected accompaniment style data is read to judge whether the read chunk is a ghost chunk. If the read chunk is a ghost chunk, the flow advances to Step SB8 indicated by a YES arrow, whereas if not, the flow branches to Step SB9.

At Step SB8 in accordance with the path stored in the ghost chunk, the basic chord conversion information of the referred accompaniment style data is read and copied to the reproduction working area 31 of RAM 3 to thereafter advance to Step SB10.

At Step SB9 the basic chord conversion information in the read chunk is read and copied to the working area 31 to thereafter advance to Step SB10.

At Step SB10 it is judged whether the selected accompaniment style data contains a section replacement chunk SRC. If it contains a section replacement chunk SRC, the flow advances to Step SB11 indicated by a YES arrow, whereas it not, the flow skips to Step SB14 indicated by a NO arrow and shown in FIG. 6B.

At Step SB11 the section replacement chunk SRC of the selected accompaniment style data is read to judge whether the read chunk is a ghost chunk. If the read chunk is a ghost chunk, the flow advances to Step SB12 indicated by a YES arrow, whereas if not, the flow branches to Step SB13 indicated by a NO arrow.

At Step SB12, in accordance with the path stored in the ghost chunk, the basic accompaniment data and basic chord conversion information of the referred accompaniment style data at the section designated by the ghost chunk are read and overwritten to be copied to the reproduction working area 31 of RAM 3. Thereafter, the flow advances to Step SB14 shown in FIG. 6B.

At Step SB13 the replacement accompaniment data and replacement chord conversion information in the read chunk are read and overwritten to be copied to the working area 31. Thereafter, the flow advances to Step SB14 shown in FIG. 6B.

Figure 6B:
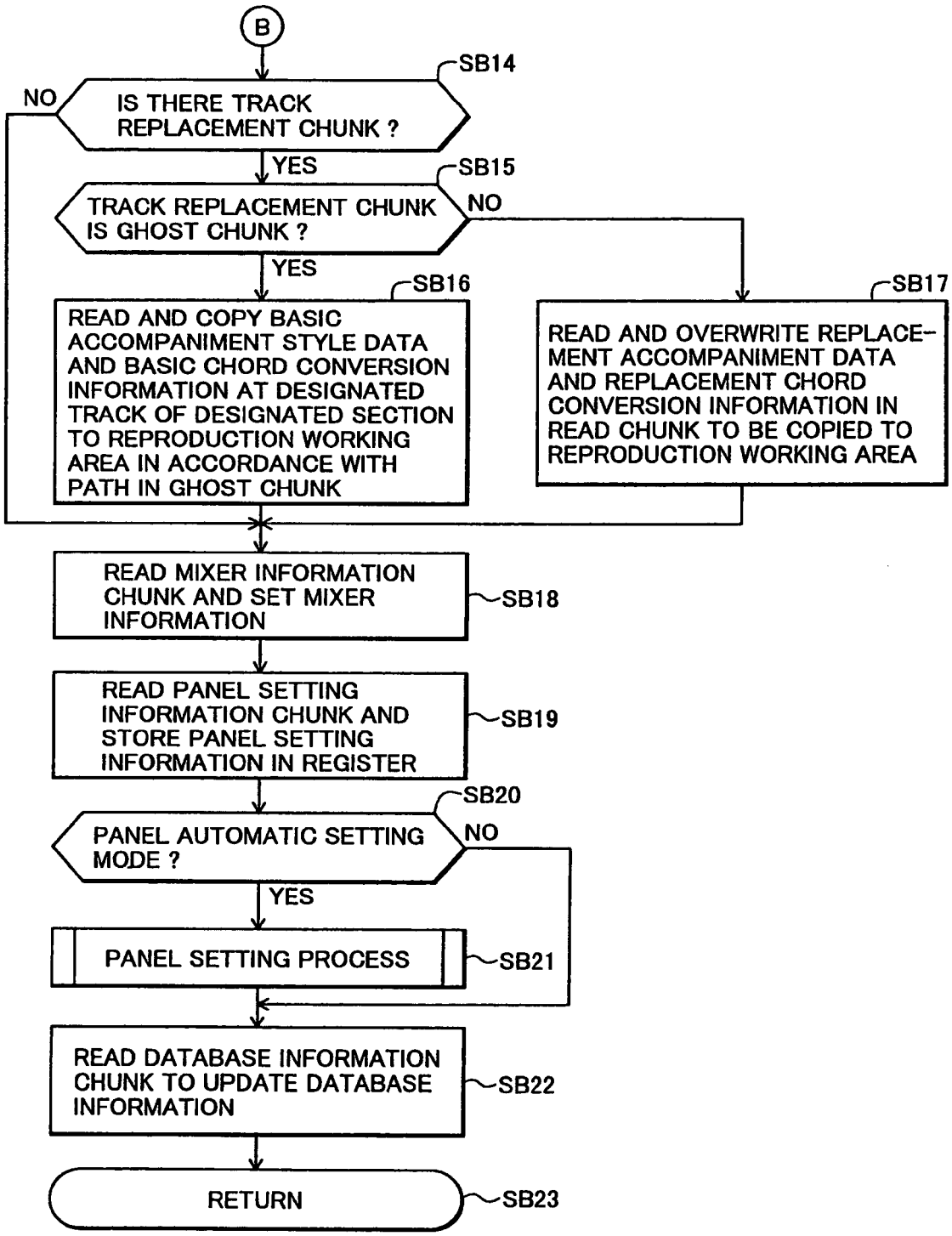

FIG. 6B is a flow chart illustrating the accompaniment style data selecting process which follows the process shown in FIG. 6A.

At Step SB14 it is judged whether the selected accompaniment style data contains a track replacement chunk TRC. If it contains a track replacement chunk, the flow advances to Step SB15 indicated by a YES arrow, whereas if not, the flow skips to Step SB18 indicated by a NO arrow.

At Step SB15 the track replacement chunk TRC in the selected accompaniment style data is read to judge whether the read chunk is a ghost chunk. If the read chunk is a ghost chunk, the flow advances to Step SB16 indicated by a YES arrow, whereas if not, the flow branches to Step SB17 indicated by a NO arrow.

At Step SB16 in accordance with the path stored in the ghost chunk, the basic accompaniment data and basic chord conversion information in the referred accompaniment style data at the track of the section designated by the ghost chunk are read and overwritten to be copied to the reproduction working area 31 of RAM 3. Thereafter, the flow advances to Step SB18.

At Step SB17 the replacement accompaniment data and replacement chord conversion information in the read chunk are read and overwritten to be copied to the working area 31. Thereafter, the flow advances to Step SB18.

At Step SB18 the mixer information chunk MIC in the selected accompaniment style data is read and set. Thereafter, the flow advances to the next Step SB19.

At Step SB19 the panel setting information chunk PSC in the selected accompaniment style data is read to store the read panel setting information in a register in RAM 3. Thereafter, the flow advances to the next Step SB20.

At Step SB20 it is judged whether the operation mode is a panel automatic setting mode. If the present mode is the panel automatic setting mode, the flow advances to Step SB21 indicated by a YES arrow, whereas if not, the flow skips to Step SB22 indicated by a NO arrow.

Figure 10:
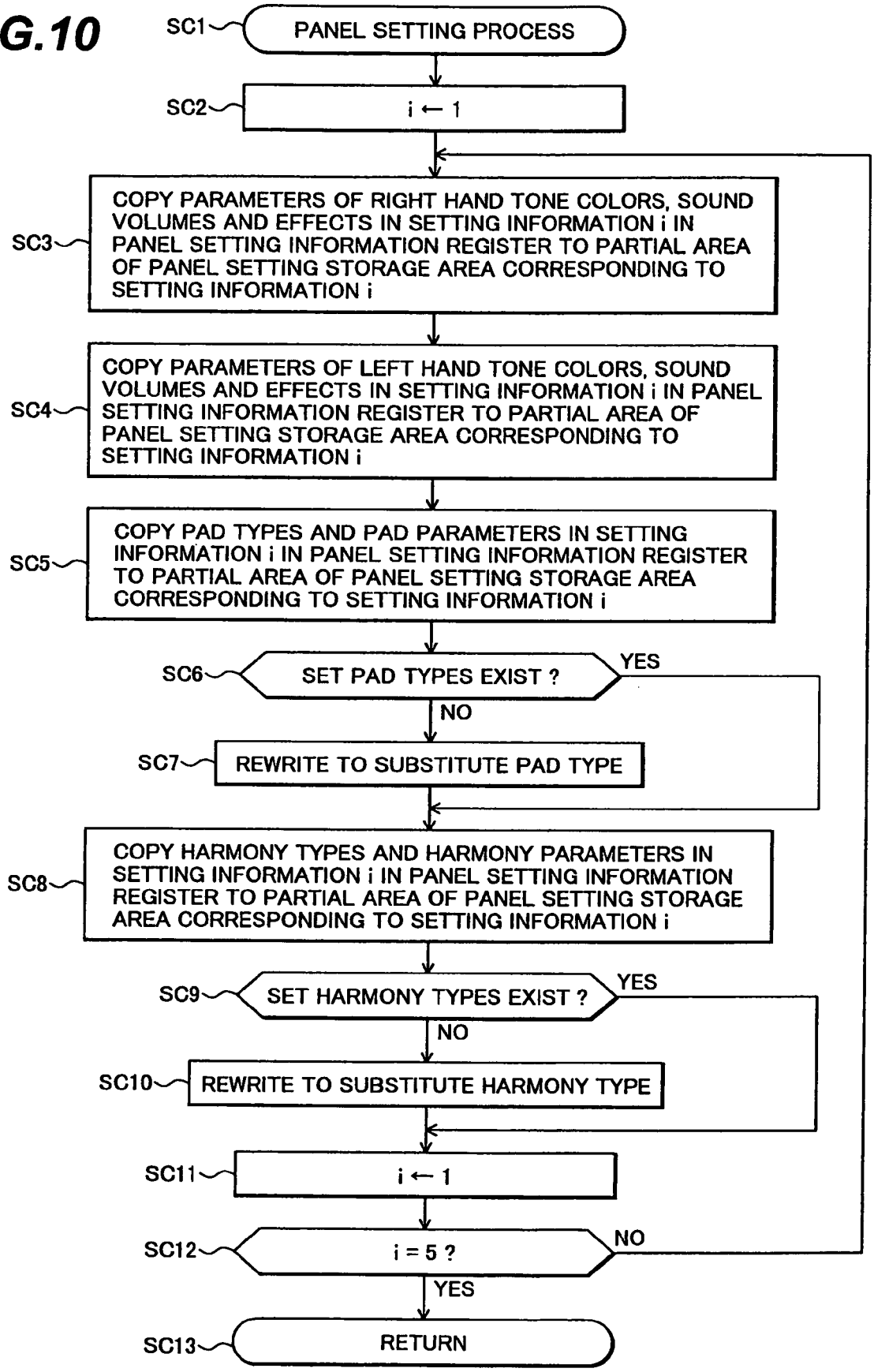
FIG. 10 is a flow chart illustrating a panel setting process to be executed at Step SB21 shown in FIG. 6B.

At Step SB21 a panel setting process illustrated in FIG. 10 is executed. After the panel setting process is completed, the flow advances to the next Step SB22.

At Step SB22 the database information chunk SIC in the selected accompaniment style data is read to update the database information. Thereafter, the flow advances to Step SB23 whereat the accompaniment style data selecting process is terminated.

Figure 7:
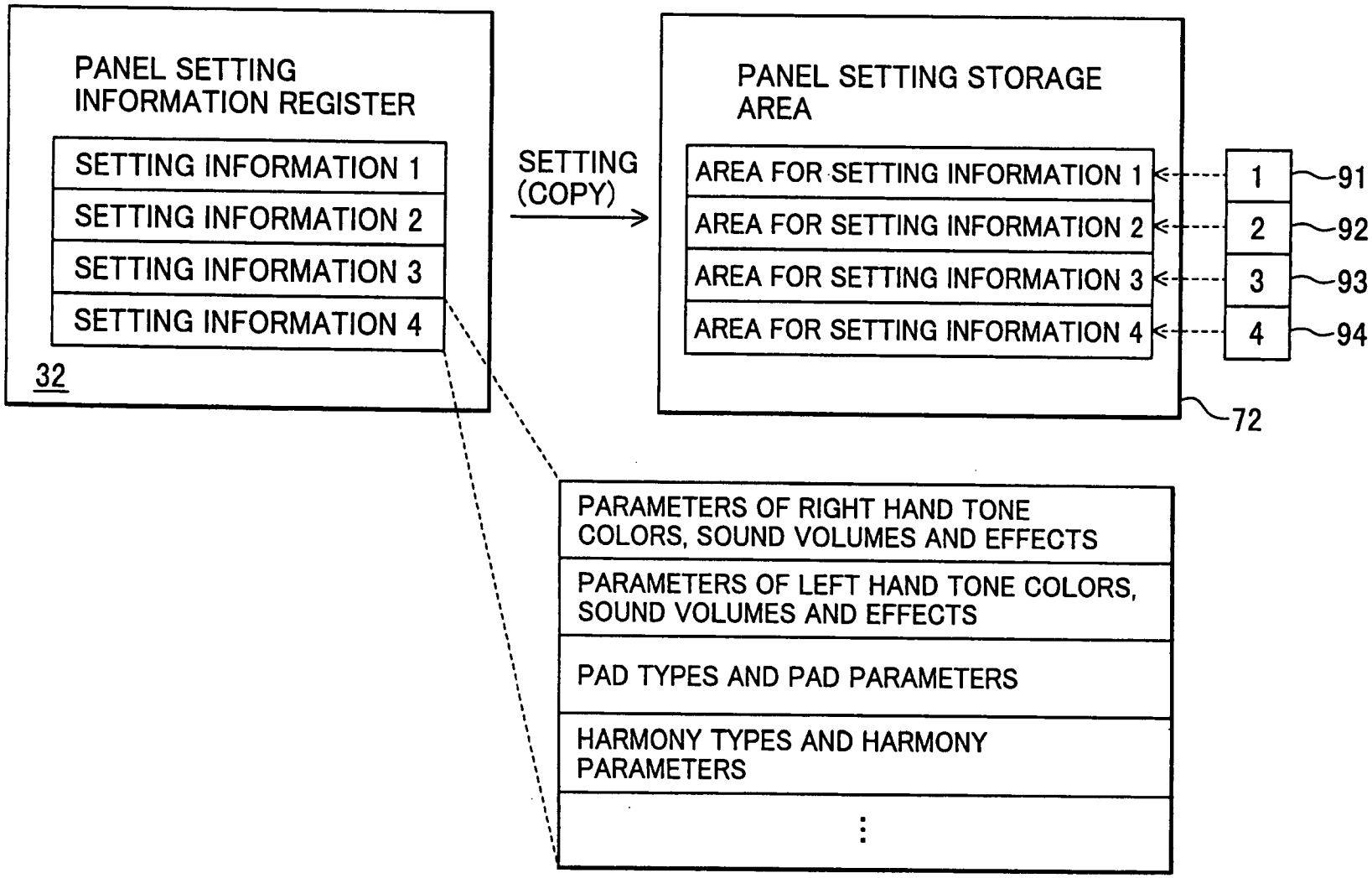
FIG. 7 is a conceptual diagram showing panel setting information stored in a register in RAM 3 at Step SB18 shown in FIG. 6B.

FIG. 7 is a conceptual diagram showing the panel setting information stored in a register in RAM 3 at Step SB18 shown in FIG. 6B.

A panel setting information register 32 stores panel setting information 1 to 4 read from the selected accompaniment style data at Step SB18 shown in FIG. 6B. Each of the panel setting information 1 to 4 includes parameters of right hand tone colors (tone colors assigned to the right half of a keyboard if the performance operation unit is the keyboard), right hand sound volumes and right hand effects, parameters of left hand tone colors (tone colors assigned to the left half of a keyboard if the performance operation unit is the keyboard), left hand sound volumes and left hand effects, pad types, pad parameters (sound volumes, velocities and the like), harmony types, and harmony parameters (sound volumes, velocities and the like).

In setting the panel setting information, first the setting information 1 to 4 stored in the register 32 is copied to setting information areas of the setting information 1 to 4 in a panel setting storage area 72 in RAM 3. The setting information areas correspond to section select switches 91 to 94 of the panel operation unit 9 of the automatic accompaniment apparatus 1.

The section select switch 91 corresponds to the intro section, the switch 92 corresponds to the main section, the switch 93 corresponds to the fill-in section, and the switch 94 corresponds to the ending section.

In the panel automatic setting mode, the setting information corresponding to the section under performance is automatically selected from the setting information 1 to 4, and the panel is set in accordance with the selected setting information.

If the operation mode is not the panel automatic setting mode, the information in the panel setting information register 32 is not automatically copied to the panel setting storage area 72, but the previous information is maintained. The information in the panel setting information register 32 is copied to the panel setting information storage area 72 only when an instruction of validating the panel setting information in the accompaniment style data is issued by operating a particular portion of the panel operation unit 9. One of the setting information 1 to 4 corresponding to one of the section setting switches 91 to 94 operated by the user is made valid and the panel is set in accordance with the selected setting information.

FIG. 8 is a table to be used for designating the pad type in the panel setting information.

Each pad type defines the types of musical tones assigned to a plurality of pads, e.g. four pads. For example, the pad type "guitar cutting 1" defines that different "guitar cutting phrases" are assigned to a plurality of pads. The "guitar cutting phrase" may be MIDI sequence or sampling waveform.

The pad type of the panel setting information of the embodiment is designated by a bank number and a program number. For example, if "bank 1, program 1" is selected, the pad type "guitar cutting 1" in the table shown in FIG. 8 is selected.

The symbol "←" in FIG. 8 means that the pad type designated by the same program number and the bank number one number before is used.

For example, if the panel setting information designates the pad type "bank 2, program 3", the pad type "guitar strum" at "bank 1, program 3" is selected.

The pad types having the same program number and different bank numbers are similar pad types. For example, "bank 2, program 4" corresponds to "drum Fil 2", and "bank 1, program 4" corresponds to "drum Fil 1" having musical tones similar to those of "drum Fil 2".

It is preferable to form a common specification for a correspondence between the bank number, program number and pad type in order to use it for a number of musical instruments (preferably musical instruments having pad functions).

It may be difficult to have all pad types depending upon the quality of musical instruments such as a low quality musical instrument. Even in such a case, it is preferable to have at least the pad types of the bank 1. In this case, if the pad type of the bank 2 or another bank is designated and the musical instrument does not have the pad type, the pad type of the bank 1 is used to perform substitute reproduction.

The substitute reproduction is not limited only to the bank 1, but the pad type of the largest bank number usable by the musical instrument may be selected. The panel setting information may contain information of a substitute pad type for each pad type.

The pitches of musical tones to be assigned to pads may be changed in accordance with the designated chord. The sound volume, tone color and the like of a musical tone may be controlled in accordance with the detected intensity of a pad operation.

Musical tones may be reproduced only while a pad is operated (during a time from ON to OFF). Only the ON operation may be used to reproduce musical tones to the last tone. If it is set so that musical tones are reproduced only while a pad is operated, after the last musical tone is reproduced, the musical tones from the start or intermediate musical tone may be repetitively reproduced.

FIG. 9 is a table to be used for designating the harmony type contained in the panel setting information.

Each harmony type defines the type of additional sounds (harmony) to be added to musical tones generated in response to the operation of the performance operation unit 15 such as a keyboard. The number of musical tones to be added, pitch, reproduction timing, sound volume, tone color and the like are different for each harmony type. For example, the harmony type " . . . duet" defines that a musical tone generated in response to the operation of the performance operation unit 15 is added with one musical tone having a predetermined pitch which changes with a chord.

The harmony type " . . . trio" defines that a musical tone generated in response to the operation of the performance operation unit 15 is added with two musical tones having a predetermined pitch which changes with a chord.

If there are a plurality of musical tones to be generated at the same time, one musical tone among the plurality of musical tones is given a harmony. For example, the musical tone having the highest pitch among them is given a harmony.

The harmony type of the panel setting information of the embodiment is designated by a bank number and a program number. For example, if "bank 1, program 1" is selected, the harmony type "standard duet 1" in the table shown in FIG. 9 is selected.

The symbol "←" in FIG. 9 means that the harmony type designated by the same program number and the bank number one number before is used. For example, if the panel setting information designates the harmony type "bank 2, program 2", the harmony type "rock duet" at "bank 1, program 2" is selected.

The harmony types having the same program number and different bank numbers are similar harmony types. For example, "bank 2, program 3" corresponds to "country duet 2", and "bank 1, program 3" corresponds to "country duet 1" having musical tones similar to those of "country duet 2".

It is preferable to form a common specification for a correspondence between the bank number, program number and harmony type in order to use it for a number of musical instruments (preferably musical instruments having harmony functions).

It may be difficult to have all harmony types depending upon the quality of musical instruments such as a low quality musical instrument. Even in such a case, it is preferable to have at least the harmony types of the bank 1. In this case, if the harmony type of the bank 2 or another bank is designated and the musical instrument does not have the harmony type, the harmony type of the bank 1 is used to perform substitute reproduction.

The substitute reproduction is not limited only to the bank 1, but the harmony type of the largest bank number usable by the musical instrument may be selected. The panel setting information may contain information of a substitute harmony type for each harmony type.

FIG. 10 is a flow chart illustrating a panel setting process to be executed at Step SB21 shown in FIG. 6B.

At Step SC1 the panel setting process starts to thereafter advance to the next Step SC2.

At Step SC2 the value of a flag i is set to "1". Thereafter, the flow advances to the next Step SC3.

At Step SC3 the parameters of right hand tone colors, sound volumes and effects of the setting information i in the panel setting information register 32 shown in FIG. 7 are copied to a partial area of the panel setting storage area 72 corresponding to the setting information i. Thereafter, the flow advances to the next Step SC4.

At Step SC4 the parameters of left hand tone colors, sound volumes and effects of the setting information i in the panel setting information register 32 are copied to a partial area of the panel setting storage area 72 corresponding to the setting information i. Thereafter, the flow advances to the next Step SC5.

At Step SC5 the pad types and pad parameters of the setting information i in the panel setting information register 32 are copied to a partial area of the panel setting storage area 72 corresponding to the setting information i. Thereafter, the flow advances to the next Step SC6.

At Step SC6 it is checked whether the pad types set at Step SC5 exist. If the set pad types do not exist, the flow advances to Step SC7 indicated by a NO arrow, whereas if the set pad types exist, the flow skips to Step SC8 indicated by a YES arrow.

At Step SC7 the pad type in the setting information i in the panel setting storage area 72 is rewritten to the substitute pad type. Thereafter, the flow advances to the next Step SC8.

At Step SC8 the harmony types and harmony parameters in the setting information i in the panel setting information register are copied to a partial area of the panel setting storage area 72 corresponding to the setting information i. Thereafter, the flow advances to the next Step SC9.

At Step SC9 it is checked whether the harmony types set at Step SC8 exist. If the set harmony types do not exist, the flow advances to Step SC10 indicated by a NO arrow, whereas if the set harmony types exist, the flow skips to Step SC11 indicated by a YES arrow.

At Step SC10 the harmony type in the setting information i in the panel setting storage area 72 is rewritten to the substitute harmony type. Thereafter, the flow advances to the next Step SC11.

At Step SC11 the harmony type in the setting information in the panel setting storage area 72 is rewritten to a substitute harmony type. Thereafter, the flow advances to the next Step SC11.

At Step SC11 "1" is added to the flag i. Thereafter, the flow advances to Step SC12.

At Step SC12 it is checked whether the value of the flag i is "5". If the value of the flag i is "5", the flow advances to Step SC13 indicated by a NO arrow, whereas if not, the flow returns to Step SC3 indicated by a NO arrow.

The process from Step SC3 to Step SC12 are repeated by four times obtained by subtracting "1" from the number (in this embodiment, "5") used at the judgement Step SC12. This value may be changed as desired.

FIG. 11 is a flow chart illustrating an automatic accompaniment process to be executed by CPU 5 shown in FIG. 1.

At Step SD1 the automatic accompaniment process starts to thereafter advance to the next Step SD2.

At Step SD2 a predetermined section is initially set. For example, the intro section is automatically selected. Thereafter, the flow advances to the next Step SD3.

At Step SD3 it is detected whether a user operates a start switch (panel operation unit 9). When the operation of the start switch is detected, the flow advances to Step SD4 indicated by a YES arrow, whereas if not, the flow skips to Step SD5.

At Step SD4 reproduction of the automatic accompaniment starts and the automatic accompaniment reproduction mode is set. The reproduction starts from the section initially set at Step SD2. Thereafter, the flow advances to the next Step SD5.

At Step SD5 the operation of one of the section select switches 91 to 94 (FIG. 7) by the user is detected. When one of the section select switches 91 to 94 is operated, the flow advances to the next Step SD6 indicated by a YES arrow, whereas if not, the flow skips to Step SD9 indicated by a NO arrow.

At Step SD6 a reproduction section is set in accordance with the operated section select switch detected at Step SD5. For example, if the section select switch 91 is operated, the intro section is set and reproduced. Thereafter, the flow advances to the next Step SD7.

At Step SD7 it is detected whether the operation mode is a panel automatic setting mode. If the present operation mode is the panel automatic setting mode, the flow advances to Step SD8 indicated by a YES arrow, whereas if not, the flow skips to Step SD9 indicated by a NO arrow.

At Step SD8 the panel setting information corresponding to the section set at Step SD6 is read from the panel setting storage area 72, and in accordance with the read contents the panel is automatically set. Thereafter, the flow advances to the next Step SD9.

At Step SD9 it is detected whether the operation mode is an automatic accompaniment reproduction mode. If the present operation mode is the automatic accompaniment reproduction mode, the flow advances to Step SD10 indicated by a YES arrow, whereas if not, the flow branches to Step SD13 indicated by a NO arrow.

At Step SD10 the accompaniment style data of the selected reproduction section at the present timing is read from the working area 31 and converted into the chord designated by the chord conversion information to reproduce it. Thereafter, the flow advances to the next Step SD11.

At Step SD11 it is checked whether the present time is a section automatic switching timing. If the present time is the section automatic switching timing, the flow returns to Step SD6 indicated by a YES arrow, whereas if not, the flow advances to Step SD12 indicated by a NO arrow.

The intro and fill-in sections are set so that immediately after the reproduction of the accompaniment data is completed, the main section is automatically reproduced. Therefore, the time when the reproduction of these intro and fill-in sections is completed is the section automatic switching timing.

The main section is repetitively reproduced until another instruction is received. In the case of the ending section, the reproduction itself of the accompaniment style data is terminated. This is not the section automatic switching timing.

At Step SD12 it is checked whether the reproduction terminating section is the ending section or whether the timing is the reproduction end timing of the accompaniment style data. If the section is the ending section or if the timing is the reproduction end timing, the flow advances to Step SB14, whereas if not, the flow branches to Step SD13.

At Step SD13 an operation of a stop switch (panel operation unit 9) by the user is detected. If the operation of the stop switch is detected, the automatic accompaniment reproduction is stopped to thereafter advance to Step SD14 indicated by a YES arrow, whereas if not, the flow advances to Step SD15 indicated by a NO arrow.

At Step SD14 the automatic accompaniment reproduction mode is terminated to thereafter advance to the next Step SD15.

At Step SD15 a manual performance process to be described later is executed. After the manual performance process is completed, the flow advances to the next Step SD16.

At Step SD16 other processes are executed. The other processes include setting a tempo of automatic accompaniment reproduction, setting a reproduction sound volume and the like. After the other processes are completed, the flow returns to Step SD3.

Figure 12:
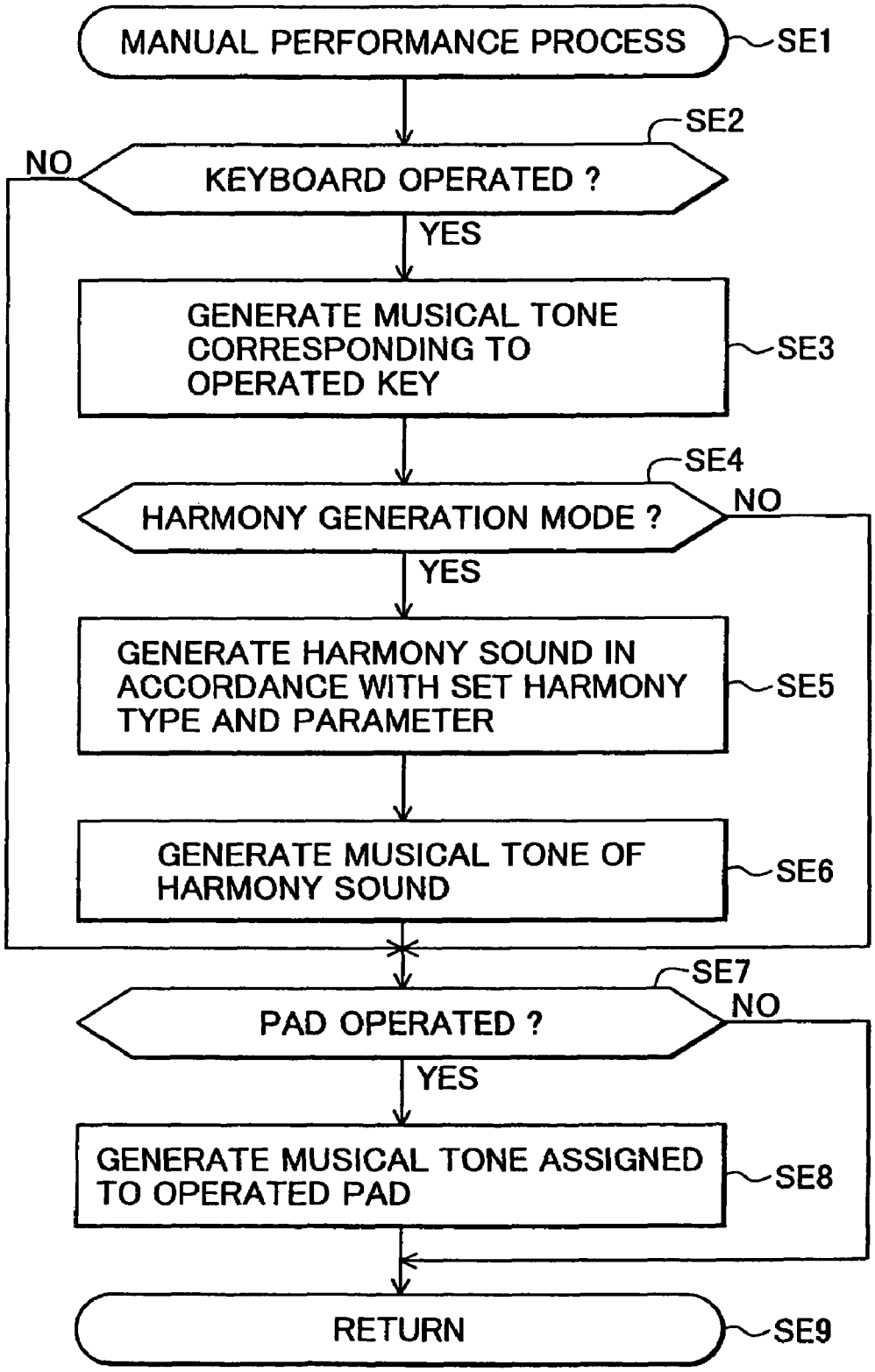
FIG. 12 is a flow chart illustrating a manual performance process to be executed at Step SD15 shown in FIG. 11.

FIG. 12 is a flow chart illustrating the manual performance process to be executed at Step SD15 shown in FIG. 11.

At Step SE1 the manual performance process is executed to thereafter advance to the next Step SE2.

At Step SE2 an operation of the keyboard (performance operation unit 15) is detected. If the operation of the keyboard is detected, the flow advances to Step SE3 indicated by a YES arrow, whereas if not, the flow skips to SE7 indicated by a NO arrow.

An operation of the electronic musical instrument 18 connected to the MIDI interface 16 may be detected in addition to or in place of the detection of an operation of the performance operation unit 15 shown in FIG. 1.

At Step SE3 a musical tone corresponding to the operated key is reproduced. Namely, the tone signal corresponding to a performance signal (e.g., a MIDI note number) input from the performance operation unit 15 or electronic musical instrument 18 is generated by the tone signal generator circuit 12. Thereafter, the flow advances to the next Step SE4.

At Step SE4 it is judged whether the current setting is a harmony generation mode. If in the harmony generation mode, the flow advances to Step SE5 indicated by a YES arrow, whereas if not, the flow skips to Step SE7 indicated by a NO arrow.

At Step SE5 a harmony tone is generated in accordance with the harmony type and parameter set by reading them from the panel setting storage area 72. Thereafter, the flow advances to the next Step SE6.

At Step SE6 the tone signal generator circuit 12 generates a musical tone of the harmony tone generated at Step SE5. Thereafter, the flow advances to the next Step SE7.

At Step SE7 an operation of a pad (performance operation unit 15) by the user is detected. If the operation of a pad is detected, the flow advances to Step SE8 indicated by a YES arrow, whereas if not, the flow skips to Step SE9 indicated by a NO arrow.

At Step SE8, a musical tone assigned to the operated pad is generated by the musical tone signal generator circuit 12. Thereafter, the flow advances to the next Step SE9.

At Step SE9 the manual performance process is terminated to thereafter advance to Step SD16 shown in the flow chart of FIG. 11.

According to the embodiment, since the replacement accompaniment data can be used as the basic accompaniment data, accompaniment style data slightly changing the already existing accompaniment style data can be generated having originality.

Since the replacement accompaniment data can be generated in the unit of accompaniment section or track, only desired sections and tracks can be altered easily.

According to the embodiment, since the replacement chord conversion information can be used as the basic chord conversion information of accompaniment style data, the same accompaniment data with altered chord conversion characteristics can be generated easily.

Since the replacement chord conversion information can be generated in the unit of accompaniment section or track, the chord conversion characteristics of only desired sections and tracks can be altered easily.

According to the embodiment, since the reference information (basic accompaniment data ghost chunk PGC) is provided for referring to another basic accompaniment style data in the unit of accompaniment section or track, another already existing accompaniment data can be utilized in the unit of section or track.

Since the reference information is used for replacement accompaniment data, another accompaniment data can be used partially as the basic accompaniment data.

According to the embodiment, since the reference information (basic chord conversion information ghost chunk CGC) is provided for referring to other basic chord conversion information, the same accompaniment data with altered chord conversion characteristics can be generated easily.

Since the reference information is used for replacement chord conversion information, other chord conversion information can be used partially as the basic chord conversion information.

According to the embodiment, since the type of a musical tone to be assigned to a pad can be managed by the bank number and program number, a number of musical instruments can use common accompaniment data.

Even if a musical instrument is not provided with a designated musical tone type, this tone type can be replaced with another musical tone type and substitute reproduction is possible.

According to the embodiment, since the type of a harmony to be added to manual performance can be managed by the bank number and program number, a number of musical instruments can use common accompaniment style data.

Even if a musical instrument is not provided with a designated harmony type, this harmony type can be replaced with another harmony type and substitute reproduction is possible.

The accompaniment style data may be preset to a musical instrument or may be created by a user.

All data or some data (in the unit of section or track) of the basic accompaniment data chunk BPC and basic chord conversion information chunk BCC may be referred by paths stored in the basic accompaniment ghost chunk PGC and basic chord conversion information ghost chunk CGC. In this case, "ghost chunks of some sections or tracks and entity data of the remaining sections or tracks" may be stored or "a plurality of ghost chunks of some sections or tracks" may be stored.

Although an absolute path (drive name¥folder name¥file name) is used as the reference information of a ghost chunk, a relative path (as looked from a current drive or the like) may also be used. For example, if the path is in the same drive, the drive name may be omitted, or if the path is in the same folder, the folder name may be omitted.

The folder structure may have a deeper hierarchical structure or other information (e.g., a file management number) may be used as the reference information in place of the path.

Setting change information such as sound volumes, tone colors and effects is stored as the mixer information. All the sound volumes, tone colors and effects are not necessary, but at least one type of them may be used.

Automatic performance chords may be supplied in real time from the performance unit such as a keyboard, or they may be supplied through reproduction by a chord sequencer.

All the mixer information chunk, panel setting information chunk and database information chunk are not necessarily required, but they may be omitted or some chunks only may be used.

The format of accompaniment data may be of any type such as an "event+relative time" type in which an occurrence time of a performance event is represented by a time starting from one previous event, an "event+absolute time" in which an occurrence time of a performance event is represented by an absolute time in music or measure, a "pitch (rest)+chord length" type in which performance data is represented by a chord pitch and chord length and by a rest and rest length, and a "direct" type in which a memory area corresponding to each minimum resolution of performance is reserved and a performance event is stored in the memory area corresponding to the time when the performance event occurs.

Any method of processing automatic accompaniment data may be used. For example, a method of changing the process cycle in accordance with a set tempo, a method of changing the value of timing data in automatic performance data in accordance with a set tempo by using a constant process cycle, a method of changing the method of counting timing data in automatic performance data, at each process by using a constant process cycle, or other methods may be used.

As a method of storing automatic accompaniment data of a plurality of channels, data of a plurality of channels may be stored in a mixed state or data of each channel data may be stored for each track.

Time sequential performance data may be stored in continuous areas of a memory, or data stored in skipped areas may be processed as continuous data. It is not necessary that data is stored in continuous areas of the memory if the data can be processed as time sequentially continuous data.

In the embodiment, although an electronic musical instrument is used ad the automatic accompaniment apparatus 1, a personal computer and application software may be used. The embodiment may be applied to a karaoke machine, a game machine, a portable communication terminal such as a mobile phone, or an automatic performance piano.

If the embodiment is applied to a portable communication terminal, required functions may be realized only by the terminal, or may be realized by a system having the terminal and a server which bears part of the required functions.

In the case of an electronic musical instrument, not only a keyboard type as in this embodiment but also a stringed type, a wind type, a percussion type and the like may be used.

The electronic musical instrument is not limited only to the type that a tone signal generator and an automatic performance apparatus are integrated in one electronic musical instrument, but it may be of the type that respective discrete apparatuses are used which are interconnected by a communication means such as MIDI and various networks.

The embodiment may be realized by a computer or the like installed with a computer program and the like realizing the embodiment functions.

In this case, the computer program and the like realizing the embodiment functions may be stored in a computer readable storage medium such as a CD-ROM and a floppy disc to distribute it to a user.

If the computer and the like are connected to the communication network such as a LAN, the Internet and a telephone line, the computer program, data and the like may be supplied via the communication network.

The present invention has been described in connection with the preferred embodiments. The invention is not limited only to the above embodiments. It is apparent that various modifications, improvements, combinations, and the like can be made by those skilled in the art.

What we claim are:

1. An automatic accompaniment apparatus comprising:

a storage unit that stores a plurality of accompaniment style data files each including at least basic accompaniment data for automatic accompaniment, which includes a series of performance event data each having time information and instruction for generating a musical tone at a timing represented by the time information; and a reproducing unit for reproducing any one of the plurality of accompaniment data files, wherein at least one of the plurality of accompaniment style data files further includes replacement accompaniment data to be reproduced in place of the basic accompaniment data, wherein the replacement accompaniment data is a series of performance event data each having time information and instruction for generating a musical tone at a timing represented by the time information, to be reproduced in place of the basic accompaniment data included in the accompaniment style data file that includes the replacement accompaniment data, wherein when an accompaniment style data file that includes the basic accompaniment data with no replacement accompaniment data is selected from among the plurality of accompaniment style data files for reproduction, the reproduction unit reproduces the basic accompaniment data included in the selected accompaniment style data file, and wherein when an accompaniment style data file that includes the basic accompaniment data with the replacement accompaniment data is selected from among the plurality of accompaniment style data files for reproduction, the reproducing unit reproduces the selected accompaniment style data file by replacing a portion of the basic accompaniment data included in the selected accompaniment style data file that includes the replacement accompaniment data.

2. The automatic accompaniment apparatus according to claim 1, wherein the basic accompaniment data includes a plurality of sections and is replaced with the replacement accompaniment data in a unit of section.

3. The automatic accompaniment apparatus according to claim 1, wherein the basic accompaniment data includes a plurality of tracks and is replaced with the replacement accompaniment data in a unit of track.

4. The automatic accompaniment apparatus according to claim 1, wherein:

the basic accompaniment data includes setting information for setting a reproduction state of the musical tone to be generated based on the basic accompaniment data;

at least one of the accompaniment style data files includes mixer information for altering the reproduction state of the musical tone set in accordance with the setting information; and said reproducing unit reproduces the musical tone in the reproduction state set in accordance with the setting information and altered by the mixer information.

5. The automatic accompaniment apparatus according to claim 1, further comprising:

an input unit for inputting performance information; and a musical tone generating unit for generating a musical tone in accordance with the performance information input from said input unit, wherein the accompaniment style data files further include panel setting information for controlling a style of the generated musical tone.

6. The automatic accompaniment apparatus according to claim 5, wherein:

the basic accompaniment data included in the accompaniment style data files includes a plurality of sections and a plurality of panel setting information sets; and each of said panel setting information sets corresponds to one of the plurality of sections.

7. An automatic accompaniment apparatus comprising:

a storage unit for storing a plurality of accompaniment style data files each of which includes at least basic accompaniment data for automatic accompaniment that includes a series of performance event data each having time information and tone information for generating a musical tone at a timing represented by the time information, wherein at least one of the plurality of accompaniment style data files further includes replacement accompaniment data to be reproduced in place of the basic accompaniment data included in the accompaniment style data file including the replacement accompaniment data, wherein the replacement accompaniment data is reference information data for referring to another accompaniment style data file other than the accompaniment style data file including the replacement accompaniment data among the plurality of accompaniment style data files for using basic accompaniment data included in the another accompaniment style data file; and a reproducing unit for reproducing any one of the plurality of accompaniment style data file, wherein:

when an accompaniment style data file including the basic accompaniment data with no replacement accompaniment data is selected from among the plurality of accompaniment style data files for reproduction, the reproducing unit reproduces the basic accompaniment data included in the selected accompaniment style data file, and when an accompaniment style data file including the basic accompaniment data and the replacement accompaniment data is selected from among the plurality of accompaniment style data files for reproduction, the reproducing unit reproduces the selected accompaniment style data file by replacing a portion of the basic accompaniment data included in the selected accompaniment style data file with the basic accompaniment data included in the another accompaniment style data file referred by the replacement accompaniment data.

8. An automatic accompaniment apparatus comprising:

a storage unit for storing a plurality of accompaniment style data files each of which includes at least basic accompaniment data for automatic accompaniment, wherein at least one of the plurality of accompaniment style data files further includes replacement accompaniment data, which is a series of performance event data each having time information and tone information for generating a musical tone at a timing represented by the time information, to be reproduced in place of the basic accompaniment data included in the accompaniment style data file including the replacement accompaniment data, and wherein each of the basic accompaniment data included in the plurality of accompaniment style data files is either a series of performance event data each having time information and tone information for generating a musical tone at a timing represented by the time information or reference information data for referring to another accompaniment style data file including the basic accompaniment data that is a series of performance event data among the plurality of accompaniment style data files for using the basic accompaniment data that is a series of performance event data included in the another accompaniment style data file; and a reproducing unit for reproducing any one of the plurality of accompaniment style data file, wherein:

when an accompaniment style data file including the basic accompaniment data is a series of performance event data with no replacement accompaniment data is selected from among the plurality of accompaniment style data files for reproduction, the reproducing unit reproduces the basic accompaniment data that is a series of performance event data in the selected accompaniment style data file, when an accompaniment style data file including the basic accompaniment data is a reference information data with no replacement accompaniment data is selected from among the plurality of accompaniment style data files for reproduction, the reproducing unit reproduces the basic accompaniment data that is a series of performance event data in the another accompaniment style data file referred by the reference information data, when an accompaniment style data file including the basic accompaniment data that is a series of performance event data and the replacement accompaniment data is selected from among the plurality of accompaniment style data files for reproduction, the reproducing unit reproduces the selected accompaniment style data file by replacing a portion of the basic accompaniment data included in the selected accompaniment style data file with the replacement accompaniment data, and when an accompaniment style data file including the basic accompaniment data that is a reference information data and the replacement accompaniment data is selected from among the plurality of accompaniment style data files for reproduction, the reproducing unit reproduces the another accompaniment style data file referred by the reference information data included in the selected accompaniment style data file by replacing a portion of the basic accompaniment data that is a series of performance event data included in the another accompaniment style data file with the replacement accompaniment data included in the selected accompaniment style data file.

9. An automatic accompaniment apparatus comprising:

a storage unit for storing a plurality of accompaniment style data files each of which includes at least basic accompaniment data for automatic accompaniment, wherein at least one of the plurality of accompaniment style data files further includes replacement accompaniment data to be reproduced in place of the basic accompaniment data included in the accompaniment style data file including the replacement accompaniment data, wherein each of the basic accompaniment data included in the plurality of accompaniment style data file is either a series of performance event data each having time information and tone information for generating a musical tone at a timing represented by the time information or a first reference information data for referring to another accompaniment style data file including basic accompaniment data that is a series of performance event data among the plurality of accompaniment style data files for using the basic accompaniment data that is a series of performance event data included in the another accompaniment style data file, and wherein the replacement accompaniment data included in said at least one of the plurality of accompaniment style data file is second reference information data for referring to yet another accompaniment style data file including the basic accompaniment data that is a series of performance event data among the plurality of accompaniment style data files for using the basic accompaniment data that is a series of performance event data included in the yet another accompaniment style data file; and a reproducing unit for reproducing any one of the plurality of accompaniment style data files, wherein:

when an accompaniment style data file including basic accompaniment data that is a series of performance event data with no replacement accompaniment data is selected from among the plurality of accompaniment style data files for reproduction, the reproducing unit reproduces the basic accompaniment data that is a series of performance event data in the selected accompaniment style data file, when an accompaniment style data file including basic accompaniment data that is the first reference information data with no replacement accompaniment data is selected from among the plurality of accompaniment style data files for reproduction, the reproducing unit reproduces the basic accompaniment data that is a series of performance event data in the another accompaniment style data file referred by the first reference information data, when an accompaniment style data file including that basic accompaniment data that is a series of performance event data and the replacement accompaniment data is selected from among the plurality of accompaniment style data files for reproduction, the reproducing unit reproduces the selected accompaniment style data file by replacing a portion of the basic accompaniment data included in the selected accompaniment style data file with the basic accompaniment data that is a series of performance event data included in yet another accompaniment style data file referred by the replacement accompaniment data, and when an accompaniment style data file including basic accompaniment data that is the first reference information data and the replacement accompaniment data is selected from among the plurality of accompaniment style data files for reproduction, the reproducing unit reproduces the another accompaniment style data file referred by the first reference information by replacing a portion of the basic accompaniment data that is a series of performance event data in the another accompaniment style data file with the basic accompaniment data that is a series of performance event data included in the yet another accompaniment style data file referred by the replacement accompaniment data included in the selected accompaniment style data file.

* * * * *